US007731183B2

(12) United States Patent
Ohno et al.

(10) Patent No.: US 7,731,183 B2
(45) Date of Patent: Jun. 8, 2010

(54) PAPER FEEDING APPARATUS WITH PAPER SIZE DETECTORS

(75) Inventors: Masahiro Ohno, Yokohama (JP); Yousuke Ushiyama, Mishima (JP); Tokihiko Ise, Tagata-gun (JP); Toshihiro Matsushima, Mishima (JP); Tetsuo Shiba, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 3 days.

(21) Appl. No.: 12/207,468

(22) Filed: Sep. 9, 2008

(65) Prior Publication Data

US 2009/0066011 A1 Mar. 12, 2009

Related U.S. Application Data

(60) Provisional application No. 60/971,237, filed on Sep. 10, 2007, provisional application No. 60/971,238, filed on Sep. 10, 2007, provisional application No. 60/971,246, filed on Sep. 10, 2007, provisional application No. 60/972,237, filed on Sep. 13, 2007, provisional application No. 60/988,733, filed on Nov. 16, 2007, provisional application No. 60/988,751, filed on Nov. 16, 2007.

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS

| | | | | |
|---|---|---|---|---|
| 5,172,903 | A * | 12/1992 | Haneda et al. | 271/171 |
| 2005/0196211 | A1 * | 9/2005 | Miki | 399/389 |
| 2006/0087073 | A1 * | 4/2006 | Yamagishi | 271/171 |

FOREIGN PATENT DOCUMENTS

| | | | |
|---|---|---|---|
| JP | 7-97069 | | 4/1995 |
| JP | 09325545 | A * | 12/1997 |
| JP | 2005-280994 | | 10/2005 |

* cited by examiner

*Primary Examiner*—Patrick Mackey
*Assistant Examiner*—Gerald W McClain
(74) *Attorney, Agent, or Firm*—Patterson & Sheridan, LLP

(57) ABSTRACT

A paper feeding apparatus includes a cassette main body that stacks a paper therein, a sidewall that moves in a width direction of the cassette main body, an end wall that moves in a longitudinal direction of the cassette main body, a first movable member that is connected at one end to the sidewall and rotates around a shaft axially fixed to the cassette main body in connection with the sidewall, a second movable member that is connected at one end to the end wall and rotates around a shaft axially fixed to the cassette main body in connection with the end wall, a first detection unit that has a plurality of detection members and detects the size of the paper in the width direction, and a second detection unit that has a plurality of detection members and detects the size of the paper in the longitudinal direction.

11 Claims, 36 Drawing Sheets

PAPER FEEDING APPARATUS WITH PAPER SIZE DETECTORS

CROSS-REFERENCE TO RELATED APPLICATION

This application claims the benefit of U.S. Provisional Applications No. 60/971,237, filed Sep. 10, 2007; No. 60/971,238, filed Sep. 10, 2007; No. 60/971,246, filed Sep. 10, 2007; No. 60/972,237, filed Sep. 13, 2007; No. 60/988,733, filed Nov. 16, 2007; and No. 60/988,751, filed Nov. 16, 2007.

TECHNICAL FIELD

The present invention relates a paper feeding apparatus that is capable of detecting the size of a paper stacked in a paper cassette.

BACKGROUND

In the related art, an image forming apparatus or a paper feeding apparatus is provided with a mechanism for detecting the size of a paper stacked in a paper cassette. With the enhancement of functionality of the image forming apparatus, the image forming apparatus becomes complicated and has a lot of members. In terms of user's convenience, it is undesirable that the image forming apparatus is increased in height in a height direction. Therefore, it is necessary to reduce the height of the paper cassette in the paper feeding apparatus disposed at a lower end of the image forming apparatus.

With the enhancement of functionality of the image forming apparatus, in order to suppress an error when printing, it is necessary to accurately detect the size of the paper stacked in the paper cassette.

The paper cassette has a sidewall and an end wall that are movable along a width direction of the stacked paper and a longitudinal direction of the paper cassette. Two paper size sensors for detecting the size of the paper stacked in the paper cassette when the paper cassette is inserted into the paper feeding apparatus are provided at a position opposed to the paper cassette on the depth side of the paper feeding apparatus. Each of the paper size sensors detects the size in the paper width direction or the longitudinal direction of the paper cassette by combinations of presses. A control unit detects the paper size on the basis of a combination of the sizes in the paper width direction and the longitudinal direction of the paper cassette detected by the two paper size sensors.

The paper cassette is provided with a movable member that is movable in accordance with the movement of the sidewall, and a movable member that is movable in accordance with the movement of the end wall. The movable members correspondingly press the paper size sensors. At this time, the movable member connected to the sidewall and the movable member connected to the end wall are disposed in the paper cassette with the same rotation fulcrum.

FIGS. 47 and 48 show a related art example of a first movable member 205 and a second movable member 206 provided in a cassette main body 201. FIG. 47 is a diagram of a paper cassette 201 when viewed from its rear surface in a state where the paper cassette 201 is inserted into an image forming apparatus 1. FIG. 48 is a diagram of a first sensor 102 and a second sensor 103 when viewed from the depth side of the image forming apparatus 1.

As shown in FIG. 47, the first movable member 205 and the second movable member 206 are disposed on the rear surface of the cassette main body 201 on the same axis. Therefore, as shown in FIG. 48, the first sensor 102 and the second sensor 103 are arranged in the height direction on the same axis of the paper feeding apparatus 20 or the image forming apparatus 1. For this reason, the paper cassette 201 cannot be decreased in height (JP-A-2005-280994).

When the printing position of an image is misaligned with respect to the paper width direction, it is necessary to shift the paper position in the paper cassette so as to be aligned with the image to be printed (hereinafter, referred to as lateral misalignment correction). When a user executes lateral misalignment correction of a paper, the sidewall is also moved. For this reason, the paper size sensors may detect a size different from a paper size desired to be actually detected or may not specify any size. For this reason, when the user executes the lateral misalignment correction of the paper in the paper cassette, it is also necessary to move the paper size sensors, which leads to complexity.

Instead of the lateral misalignment correction of the paper, a method of correcting the position of an image when printing may be used. In this case, however, it is necessary to set a printable region in the image forming apparatus by an amount corresponding to the amount of lateral misalignment correction. For this reason, the image forming apparatus is increased in size, and manufacturing costs become high. In addition, according to this method, the position of the paper in the paper cassette is not corrected, and accordingly the paper is conveyed into the apparatus at a position different from a normal position. Then, the paper may collide against an unexpected place, and paper jam or bending may occur. When a lateral misalignment adjustment mechanism for the lateral misalignment correction is provided, it is necessary for the user to adjust the paper size sensors.

Accordingly, aspects of the invention provide a paper feeding apparatus that is capable of accurately detecting the size of a paper stacked in a paper cassette without increasing the size of the apparatus.

SUMMARY

According to one aspect of the present invention, there is provided a paper feeding apparatus comprising; a cassette main body that stacks a paper therein, a sidewall that moves in a width direction of the cassette main body, an end wall that moves in a longitudinal direction of the cassette main body, a first movable member that is connected at one end thereof to the sidewall, rotates around a shaft axially fixed to the cassette main body in connection with the sidewall, and has a first detection portion at the other end thereof, a second movable member that is connected at one end thereof to the end wall, rotates around a shaft axially fixed to the cassette main body in connection with the end wall, and has a second detection portion at the other end thereof, a first detection unit that has a plurality of detection members and detects the size of the paper in the width direction according to the first detection portion provided in the first movable member, and a second detection unit that has a plurality of detection members and detects the size of the paper in the longitudinal direction according to the second detection portion provided in the second movable member.

DETAILED DESCRIPTION

Hereinafter, embodiments will be described.

Figure 1:
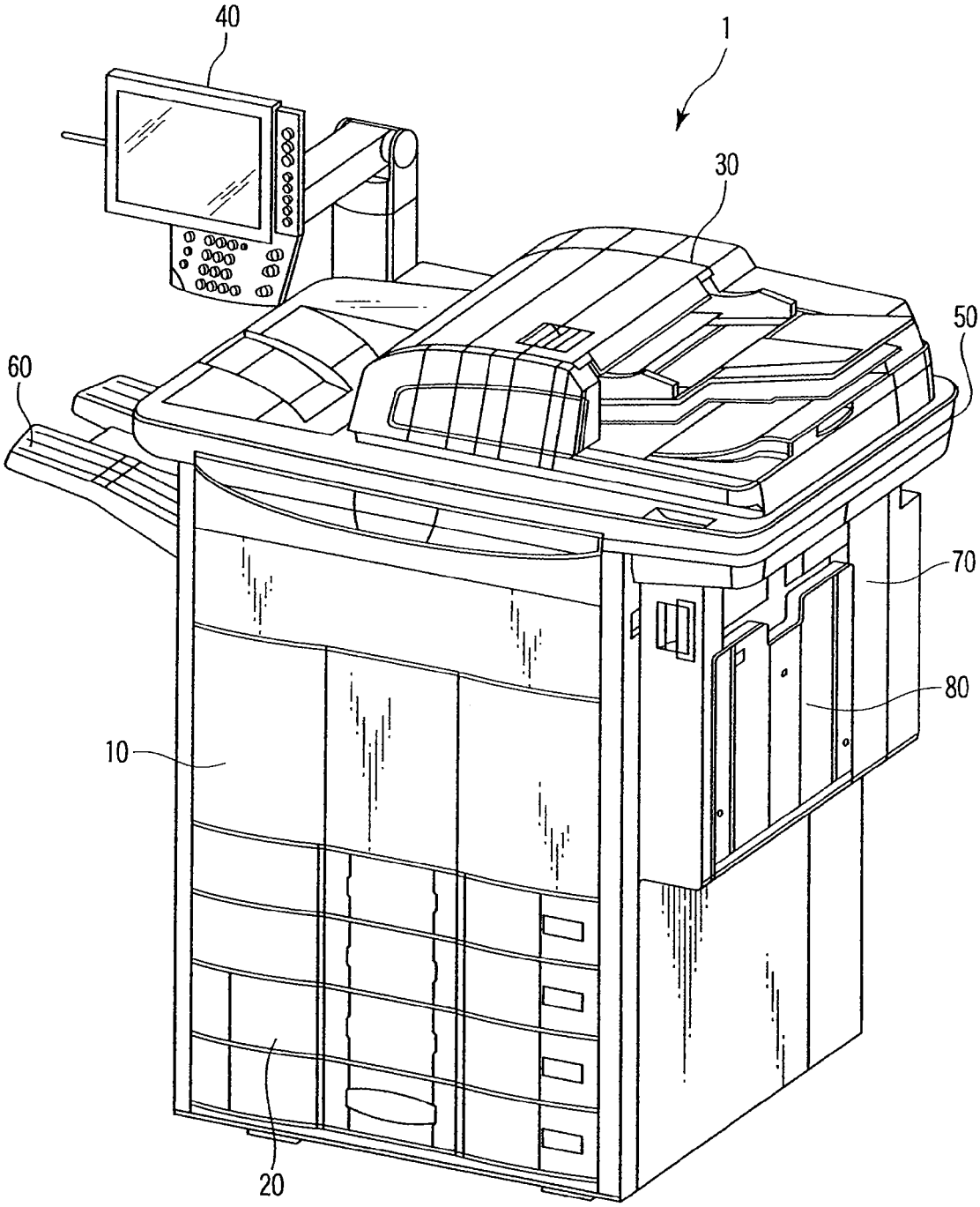
FIG. 1 is a schematic view showing the exterior of an image forming apparatus according to a first embodiment.

FIG. 1 is a perspective view showing the exterior of an image forming apparatus 1 according to an embodiment. The image forming apparatus 1 has an image forming unit 10 that outputs image information as an output image, called hard copy or print out, a paper feeding apparatus 20 that is capable of feeding a paper (output medium) of an arbitrary size for image output to the image forming unit 10, and a scanner 50 that acquires image information to be formed in the image forming unit 10 from an object (hereinafter, referred to as original document) including image information as image data. The paper feeding apparatus 20 has a paper cassette 201 (shown in FIG. 3) that accommodates papers of an arbitrary size and is attached with respect to the paper feeding apparatus 20. When the original document is sheet-like, the scanner 50 is provided with an automatic document feeder 30 that, after image output is formed or image information is read, discharges the read original document from a read position to a discharge position, and guides a next original document to the read position. In addition, an instruction input unit for instructing the image forming unit 10 to start image formation or instructing the scanner 50 to read image information of the original document, that is, a control panel 40 is provided at a predetermined position.

Figure 3:
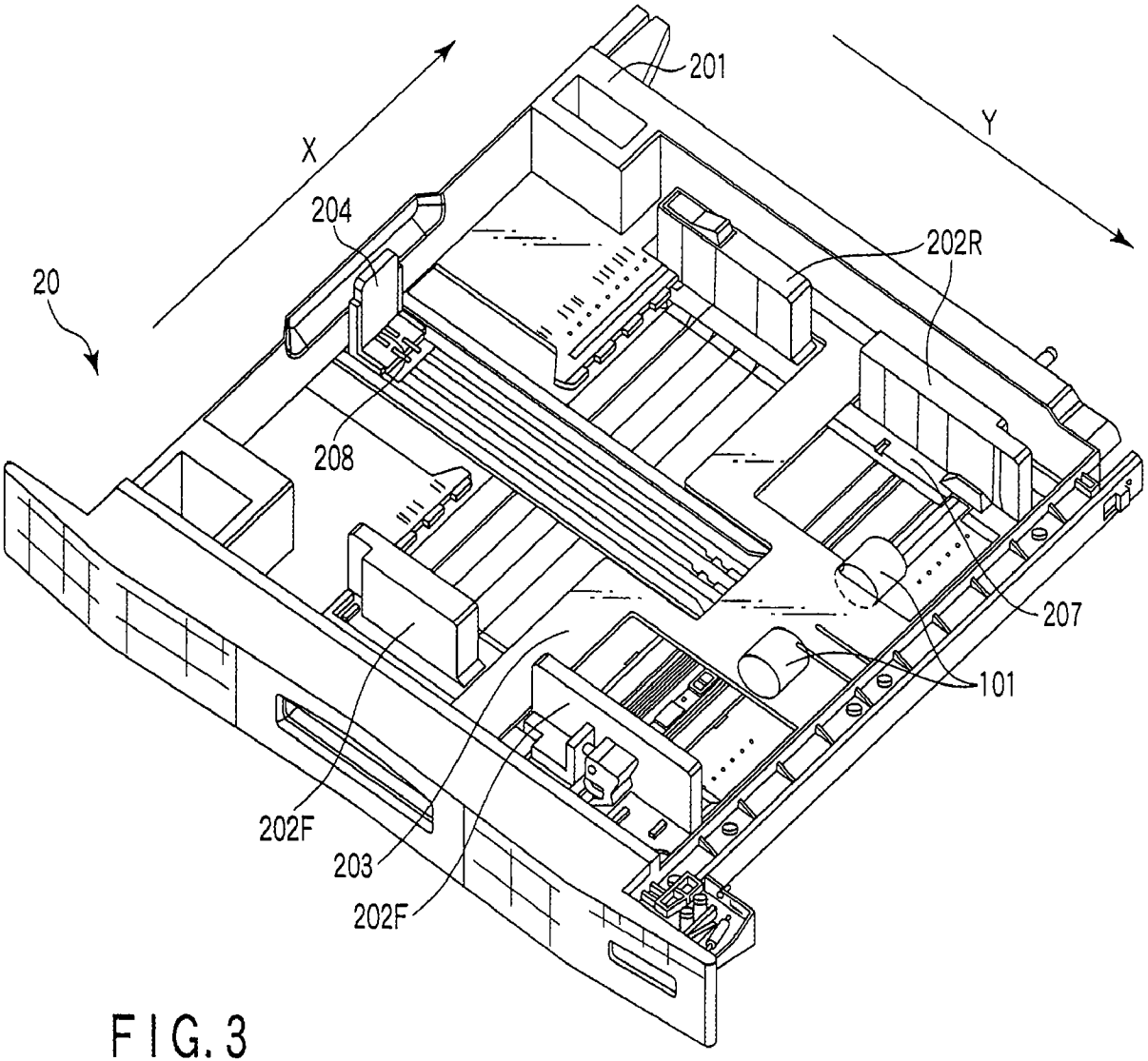
FIG. 3 is a top perspective view of a paper cassette detachably mounted in the paper feeding apparatus according to the first embodiment.

Here, a side on which the paper cassette 201 shown in FIG. 3 is attached to the paper feeding apparatus 20 is defined as the near side of the image forming apparatus 1 or the paper feeding apparatus 20. A side opposite to the side on which the paper cassette 201 shown in FIG. 3 is attached to the paper feeding apparatus 20 is defined as the depth side of the image forming apparatus 1 or the paper feeding apparatus 20. A paper discharge tray 60 for discharging a paper printed in the image forming unit 10 is provided on a side surface of the image forming apparatus 1. A first opening and closing member 70 and a second opening and closing member 80 are provided on a side surface opposite to the side on which the paper discharge tray 60 is provided.

The first opening and closing member 70 is a paper convey unit that is provided so as to be connected to the image forming unit body 10. The second opening and closing member 80 is a manual paper feed unit that is provided so as to abut to the first opening and closing member 70.

Figure 2:
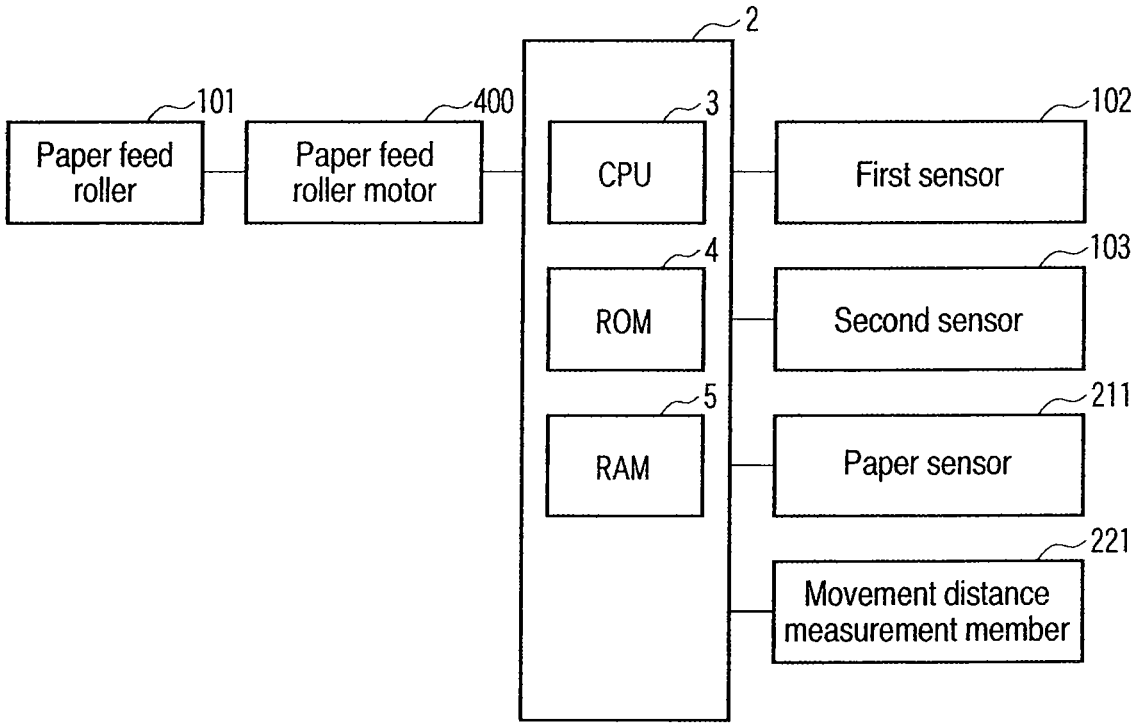
FIG. 2 is a block diagram showing a control system of a paper feeding apparatus according to the first embodiment.

FIG. 2 is a block diagram showing the control system of the paper feeding apparatus 20 according to this embodiment.

A control device 2 has a CPU 3, a ROM 4, and a RAM 5. The CPU 3 controls individual sensors and motors on the basis of control information previously recorded in the ROM 4. The RAM 5 temporarily records necessary information.

FIG. 3 is a top perspective view of the paper cassette 201 detachably mounted in the paper feeding apparatus 20. An arrow x denotes a mounting direction with respect to the paper feeding apparatus 20.

The paper feeding apparatus 20 is provided with paper feed rollers 101 that, when the paper cassette 201 is inserted, convey a bundle of papers stacked in the paper cassette 201 one by one from the top to the image forming unit 10. The paper feed rollers 101 convey the paper in a Y direction perpendicular to an X direction in which the paper cassette 201 is inserted into the paper feeding apparatus 20.

Near the positions in contact with the side surfaces on the near and depth side of a bundle of papers stacked in the paper cassette 201, a front-side sidewall 202F (near side) and a rear-side sidewall 202R (depth side) are provided. The front-side sidewall 202F (near side) and the rear-side sidewall 202R move in the X direction (hereinafter, referred to as the width direction of the paper cassette 201) perpendicular to the Y direction in which the paper is conveyed.

The front-side sidewall 202F and the rear-side sidewall 202R are formed to be movable, for example, in 1.0 mm pitch by two pinion gears 213 and a pinion gear holding member 212. If one of the front-side sidewall 202F and the rear-side sidewall 202R moves, the other one moves (described with reference to FIG. 26). The front-side sidewall 202F and the rear-side sidewall 202R are spaced at a predetermined interval (allowance) in order to eliminate a shift in parallelism with respect to the Y direction in which the paper set in the paper cassette 201 is conveyed, and regulate the position of the paper in the width direction.

The paper cassette 201 is provided with a pressing plate 203 that presses the entire paper against the paper feed rollers 101 from the bottom (bottom surface) of the paper cassette 201 in order to make sure conveyance of the paper by the paper feed rollers 101.

At an end opposite to the paper feed rollers 101 in the Y direction (the longitudinal direction of the paper cassette 201) in which the paper stacked in the paper cassette 201 is conveyed, an end wall 204 is provided. The end wall 204 moves back and forth with respect to the longitudinal direction of the paper cassette 201, and regulates the position of the paper cassette 201 in the longitudinal direction. An end of the paper in contact with the end wall 204 is referred to as a paper rear end.

Figure 4:
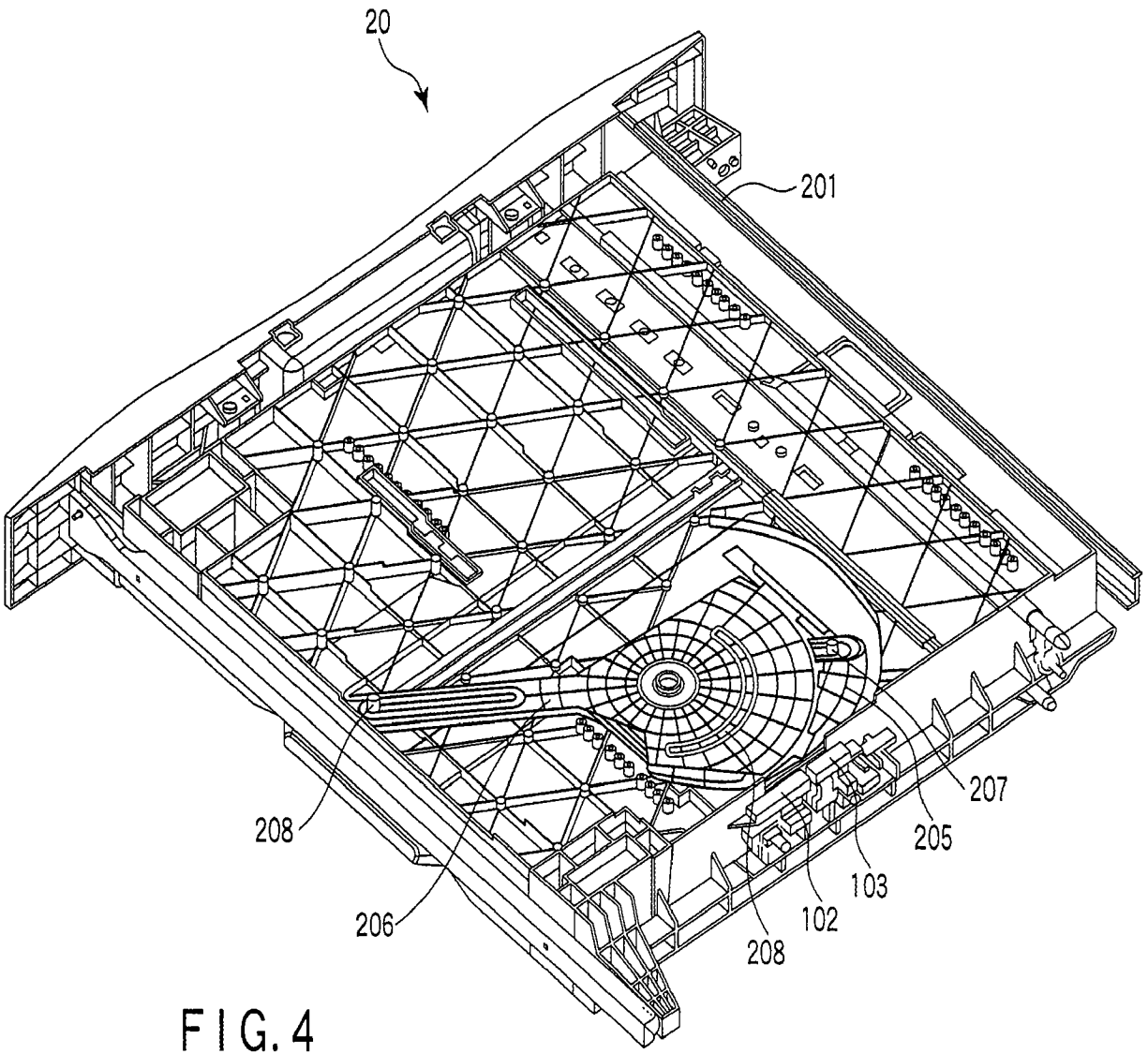
FIG. 4 is a bottom perspective view of the paper cassette detachable mounted in the paper feeding apparatus according to the first embodiment.
Figure 5A:
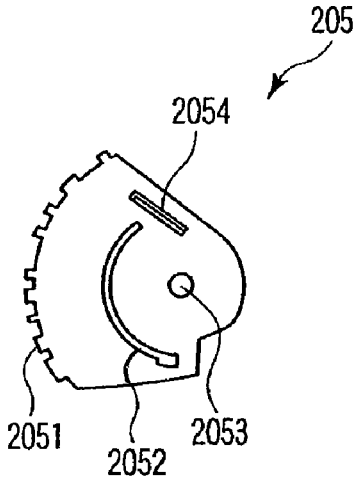
FIGS. 5A and 5B are diagrams showing the shapes of a first movable member and a second movable member according to the first embodiment.
Figure 5B:
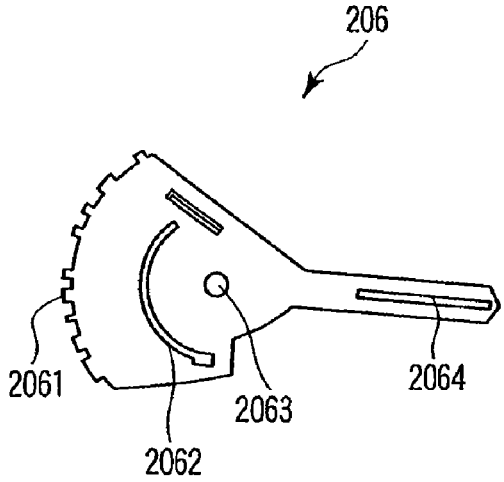

FIG. 4 is a bottom perspective view of the paper cassette 201 detachably mounted in the paper feeding apparatus 20. On the rear surface of the paper cassette 201, a first movable member 205 and a second movable member 206 are provided. FIGS. 5A and 5B show the shapes of the first movable member 205 and the second movable member 206. The first movable member 205 (or the second movable member 206) has a comb-teeth member 2051 (2061) which is arc-shaped and having a plurality of protrusions and serving as a detection portion. The first movable member 205 (or the second movable member 206) has a first joint groove 2052 (2062), a shaft hole 2053 (2063), and a second joint groove 2054 (2064).

The first movable member 205 and the second movable member 206 are axially supported on the rear surface of the paper cassette 201 through the shaft hole 2053 and the shaft hole 2063, respectively, so as to rotate around a shaft. The rear-side sidewall 202R on the depth side provided in the upper surface of the paper cassette 201 and the second joint groove 2054 of the first movable member 205 disposed on the rear surface of the paper cassette 201 are connected by a first connection member 207. The rear-side sidewall 202R is threadably mounted from the rear-side sidewall 202R side by the first connection member 207. Similarly, the end wall 204 provided in the upper surface of the paper cassette 201 and the second joint groove 2064 of the second movable member 206 disposed on the rear surface of the paper cassette 201 are connected by a second connection member 208. The end wall 204 is threadably mounted from the end wall 204 side by the second connection member 208. As for the first movable member 205 and the second movable member 206, the first joint groove 2052 and the second joint groove 2062 are connected with each other by the second connection member 208.

Figure 6:
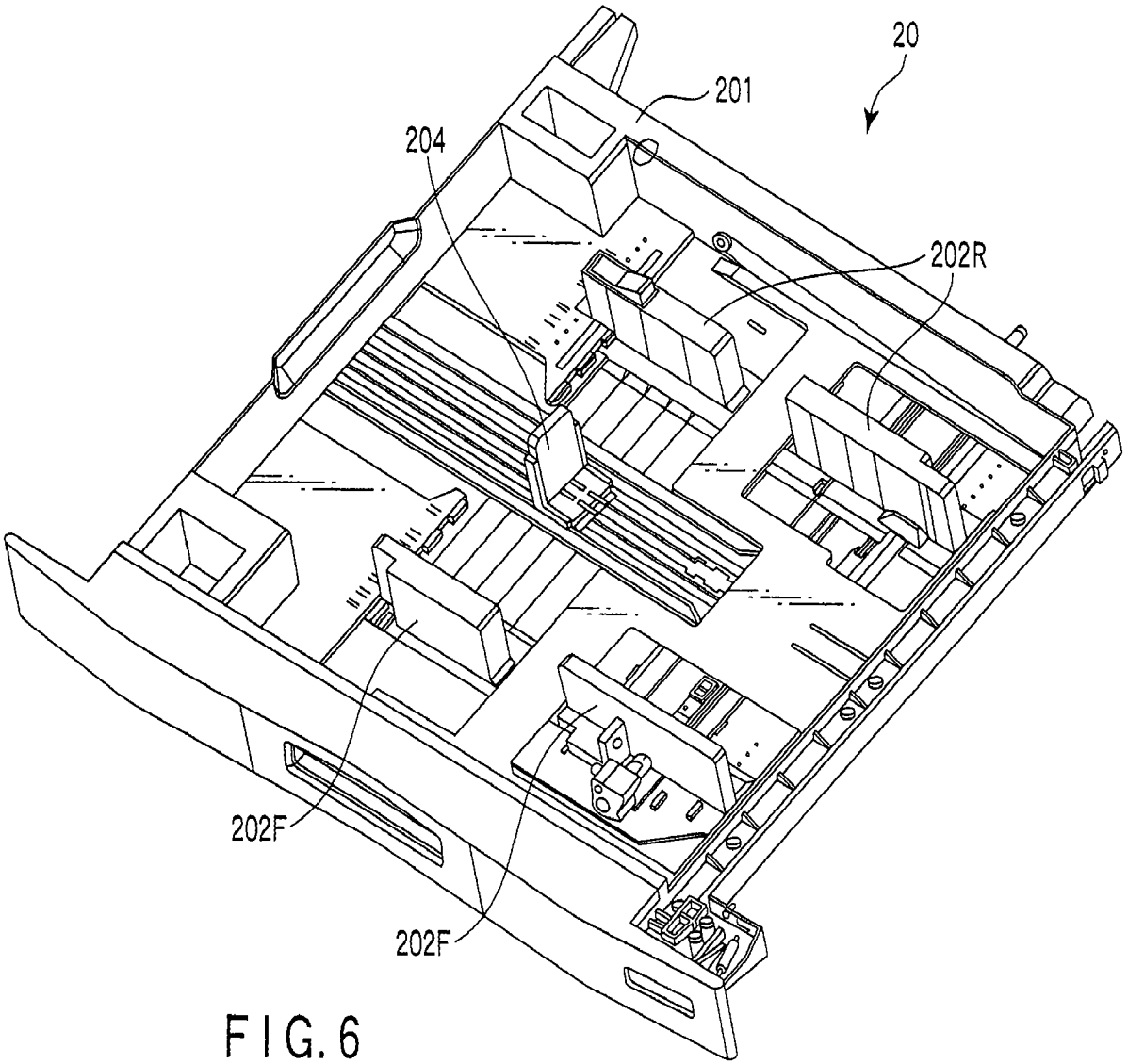
FIG. 6 is a top perspective view of the paper cassette detachably mounted in the paper feeding apparatus according to the first embodiment.
Figure 7:
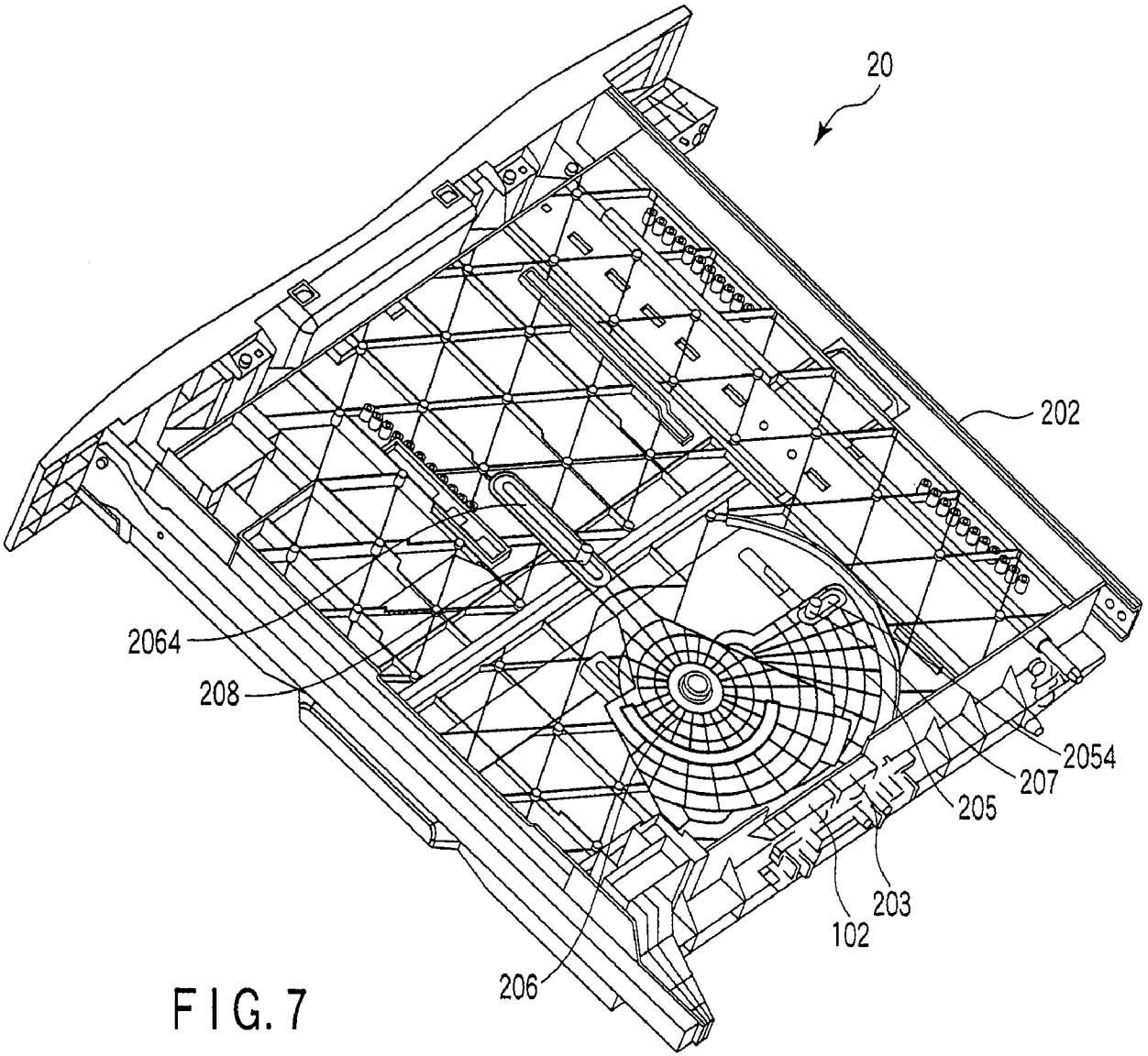
FIG. 7 is a bottom perspective view of the paper cassette detachably mounted in the paper feeding apparatus according to the first embodiment.

FIG. 6 is a top perspective view of the paper cassette 201 detachably mounted in the paper feeding apparatus 20. FIG. 7 is a bottom perspective view of the paper cassette 201 detachably mounted in the paper feeding apparatus 20.

The paper cassette 201 shown in FIGS. 6 and 7 is in a state where, when a paper of a smaller size than the paper stacked in the paper cassette 201 shown in FIGS. 3 and 4 is stacked, the front-side sidewall 202F, the rear-side sidewall 202R, and the end wall 204 are moved.

If the front-side sidewall 202F and the rear-side sidewall 202R move from the state shown in FIG. 3 and to the state shown in FIG. 6 in a direction to narrow an interval of the paper cassette 201 in the width direction, the first connection member 207 rotates the first movable member 205 around the shaft while moving in the second joint groove 2054.

If the end wall 204 moves from the state shown in FIG. 3 to the state shown in FIG. 6 in a direction to narrow an interval of the paper cassette 201 in the longitudinal direction, the second connection member 208 rotates the second movable member 206 around the shaft while moving in the second joint groove 2064.

Figure 10:
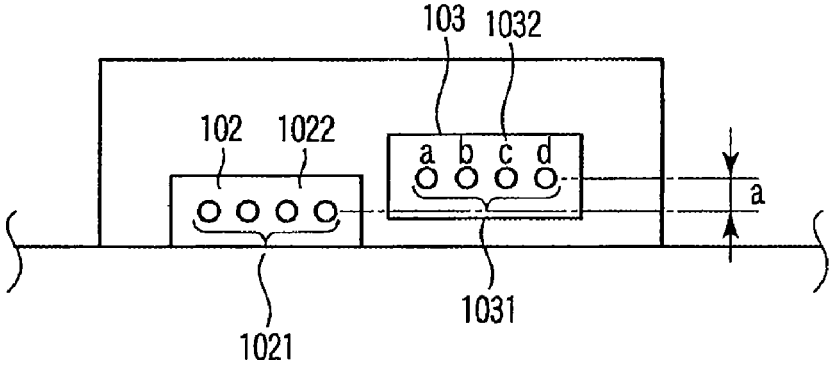
FIG. 10 is a diagram of the first sensor and the second sensor according to the first embodiment when viewed from the near side of the paper feeding apparatus.
Figure 8:
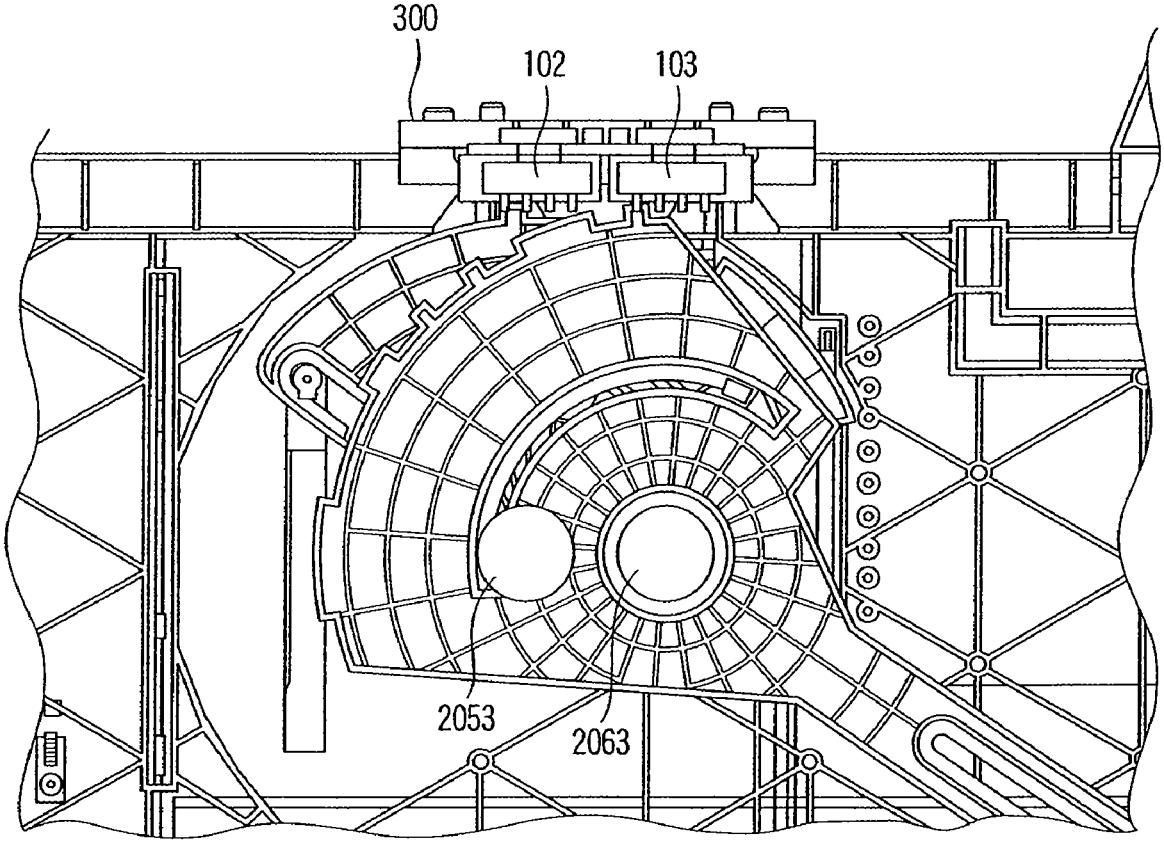
FIG. 8 is a diagram showing the rear surface of the paper cassette inserted into the paper feeding apparatus according to the first embodiment.
Figure 9:
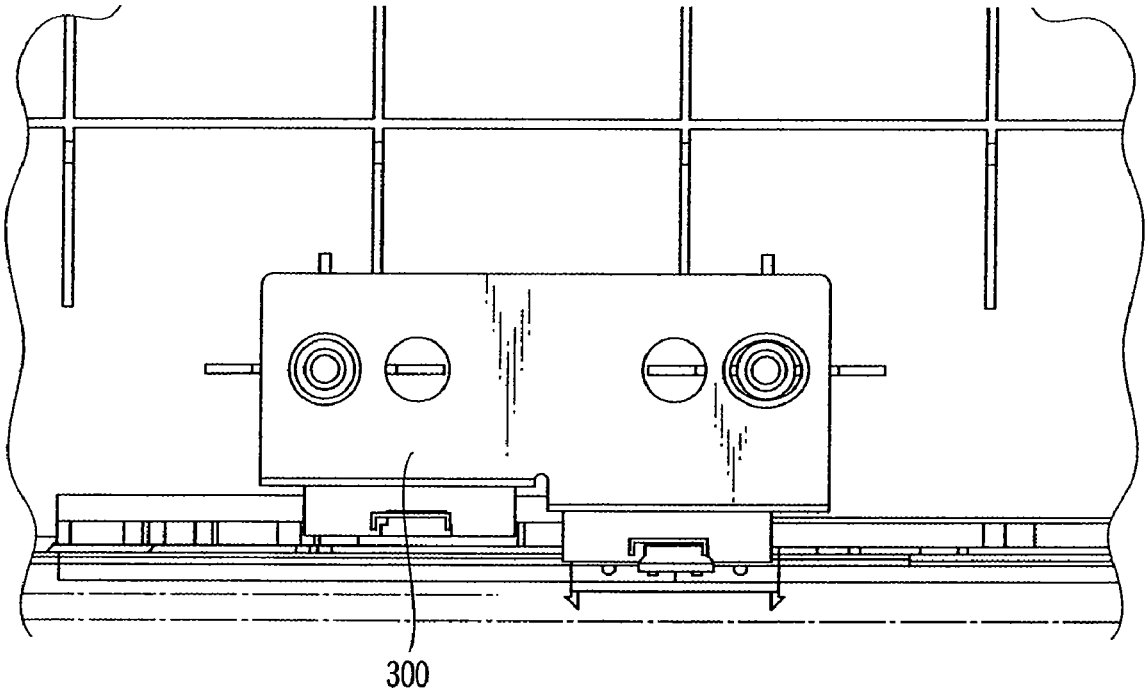
FIG. 9 is a diagram of a first sensor and a second sensor according to the first embodiment when viewed from the depth side of the paper feeding apparatus.

Next, a description will be provided for a first sensor 102 and a second sensor 103 serving as a detection unit provided on the depth side of the paper feeding apparatus 20 when the paper cassette 201 is inserted into the paper feeding apparatus 20. FIG. 8 is a diagram showing the rear surface of the paper cassette 201 when the paper cassette 201 is inserted into the paper feeding apparatus 20. FIG. 9 is a diagram of the first sensor 102 and the second sensor 103 when viewed from the depth side of the paper feeding apparatus 20. FIG. 10 is a diagram of the first sensor 102 and the second sensor 103 when viewed from the near side of the paper feeding apparatus 20.

In the paper feeding apparatus 20, the first sensor 102 is provided at a position in contact with the comb-teeth member 2051 provided in the first movable member 205 on the depth side of the paper feeding apparatus 20 when the paper cassette 201 is inserted into the paper feeding apparatus 20. In addition, in the paper feeding apparatus 20, the second sensor 103 is provided at a position in contact with the comb-teeth member 2061 provided in the second movable member 206 on the depth side of the paper feeding apparatus 20 when the paper cassette 201 is inserted into the paper feeding apparatus 20.

The first sensor 102 has four protrusion members 1021 serving as detection members that protrude from the depth side to the near side. Similarly, the second sensor 103 has four protrusion members 1031 that protrude from the depth side to the near side. The CPU 3 discriminates the size of the paper cassette 201 in the width direction by combinations of presses of the four protrusion members 1021 provided in the first sensor 102. Similarly, the CPU 3 detects the size of the paper cassette 201 in the longitudinal direction by combinations of presses of the four protrusion members 1031 provided in the second sensor 103. The CPU 3 discriminates the size of the paper stacked in the paper cassette 201 on the basis of the size of the paper cassette 201 in the width direction and the size of the paper cassette 201 in the longitudinal direction.

The first movable member 205 is rotated in accordance with the movements of the front-side sidewall 202F and the rear-side sidewall 202R, and accordingly the comb-teeth member 2051 in contact with the first sensor 102 is change in shape. Therefore, the first sensor 102 detects the size of the paper cassette 201 in the width direction by press patterns of the comb-teeth member 2051 on the four protrusion members 1021 provided in the first sensor 102.

Similarly, the second movable member 206 is rotated in accordance with the movement of the end wall 204, and accordingly the comb-teeth member 2061 in contact with the second sensor 103 is changed in shape. Therefore, the second sensor 103 detects the size of the paper cassette 201 in the longitudinal direction by press patterns of the comb-teeth member 2061 on the four protrusion members 1031 provided in the second sensor 103.

In this embodiment, as shown in FIG. 8, the first movable member 205 and the second movable member 206 are disposed on the rear surface of the paper cassette 201 on different axes, not on the same axis. A connection shaft of the first movable member 205 to the paper cassette 201 and a connection shaft of the second movable member 206 to the paper cassette 201 are provided to be arranged along the width direction of the paper cassette 201, which is the horizontal direction of the image forming apparatus 1.

As shown in FIG. 10, the first sensor 102 and the second sensor 103 have the same shape. The first sensor 102 has four protrusion members 1021 provided on a boxlike member 1022, in which a board is incorporated, in the horizontal direction of the image forming apparatus 1. The second sensor 103 has four protrusion members 1031 provided on a boxlike member 1032, in which a board is incorporated, in the horizontal direction of the image forming apparatus 1.

The protrusion members 1021 have a columnar shape having a diameter smaller than the height of the boxlike member 1022 of the first sensor 102. The boxlike member 1022 of the first sensor 102 has a height equal to or larger than the thickness of the first movable member 205. Similarly, the protrusion members 1031 have a columnar shape having a diameter smaller than the height of the boxlike member 1032 of the second sensor 103. The boxlike member 1032 of the second sensor 103 has a height equal to larger than the thickness of the second movable member 206.

For this reason, if the first sensor 102 and the second sensor 103 are arranged in the height direction on the same axis of the paper feeding apparatus 20, the boxlike member 1022 of the first sensor 102 and the boxlike member 1022 of the second sensor 103 are superimposed and increase in height. In this embodiment, as shown in FIG. 10, the shaft of the first movable member 205 and the shaft of the second movable member 206 are provided to be arranged along the width direction of the paper cassette 201. A position where the comb-teeth member 2051 of the first movable member 205 is opposed to the first sensor 102 and a position where the comb-teeth member 2061 of the second movable member 206 is opposed to the second sensor 103 are shifted in the horizontal direction.

As shown in FIG. 10, the first sensor 102 and the second sensor 103 are provided on the depth side of the paper feeding apparatus 20 to be shifted in the horizontal direction at positions not opposed to each other in the height direction. The first sensor 102 and the second sensor 103 are provided so as to at least partially overlap each other in the horizontal direction.

An interval a between a center axis in the horizontal direction of the protrusion members 1022 arranged in the first sensor 102 and a center axis in the horizontal direction of the protrusion members 1032 arranged in the second sensor 103 is narrowed, as compared with a case where the first sensor 102 and the second sensor 103 are disposed to overlap each other in the height direction. Therefore, the paper cassette 201 is reduced in height, as compared with the related art example.

The first movable member 205 and the second movable member 206 are disposed in the paper cassette 201 to be axially shifted in the width direction of the paper cassette 201. However, since the paper cassette 201 has a size corresponding to a paper of a stackable maximum size, even if the first movable member 205 and the second movable member 206 are axially shifted in the width direction of the paper cassette 201, there is no case where the structure is increased in size.

Figure 11:
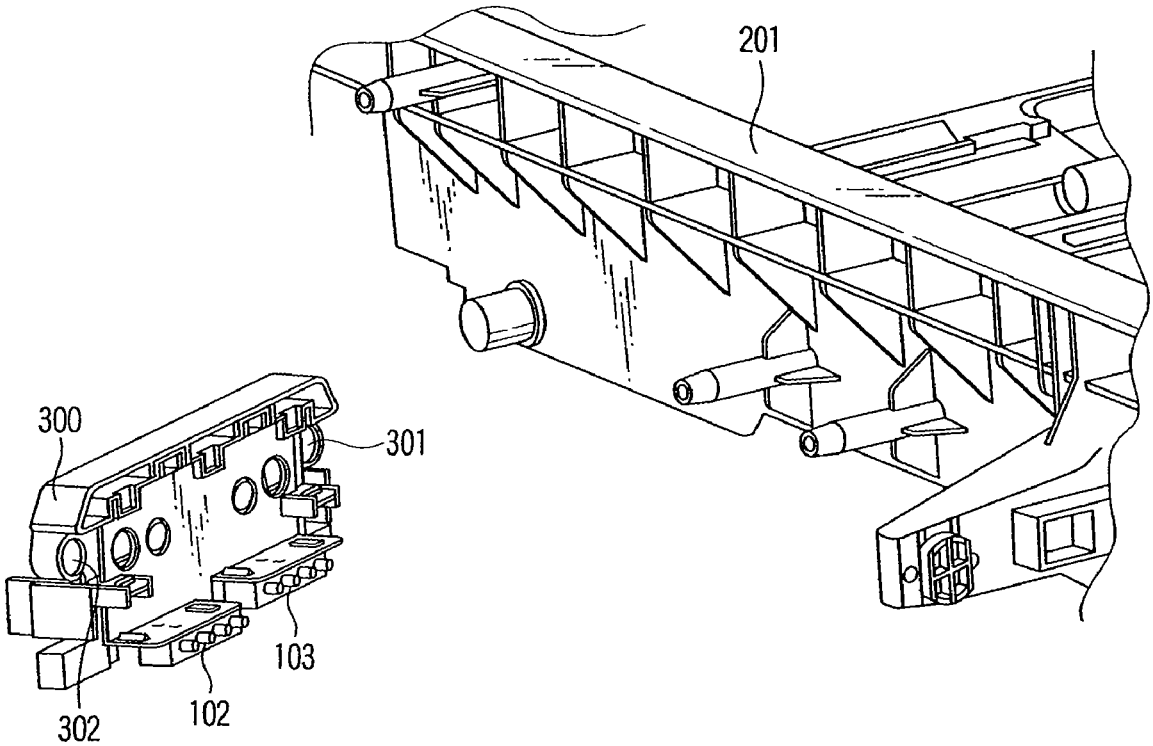
FIG. 11 is a diagram showing a sensor board according to a second embodiment.

Next, a second embodiment will be described. FIG. 11 is a diagram showing a sensor board 300 which is disposed on the depth side of the paper feeding apparatus 20 and on which the first sensor 102 and the second sensor 103 are provided.

Figure 12:
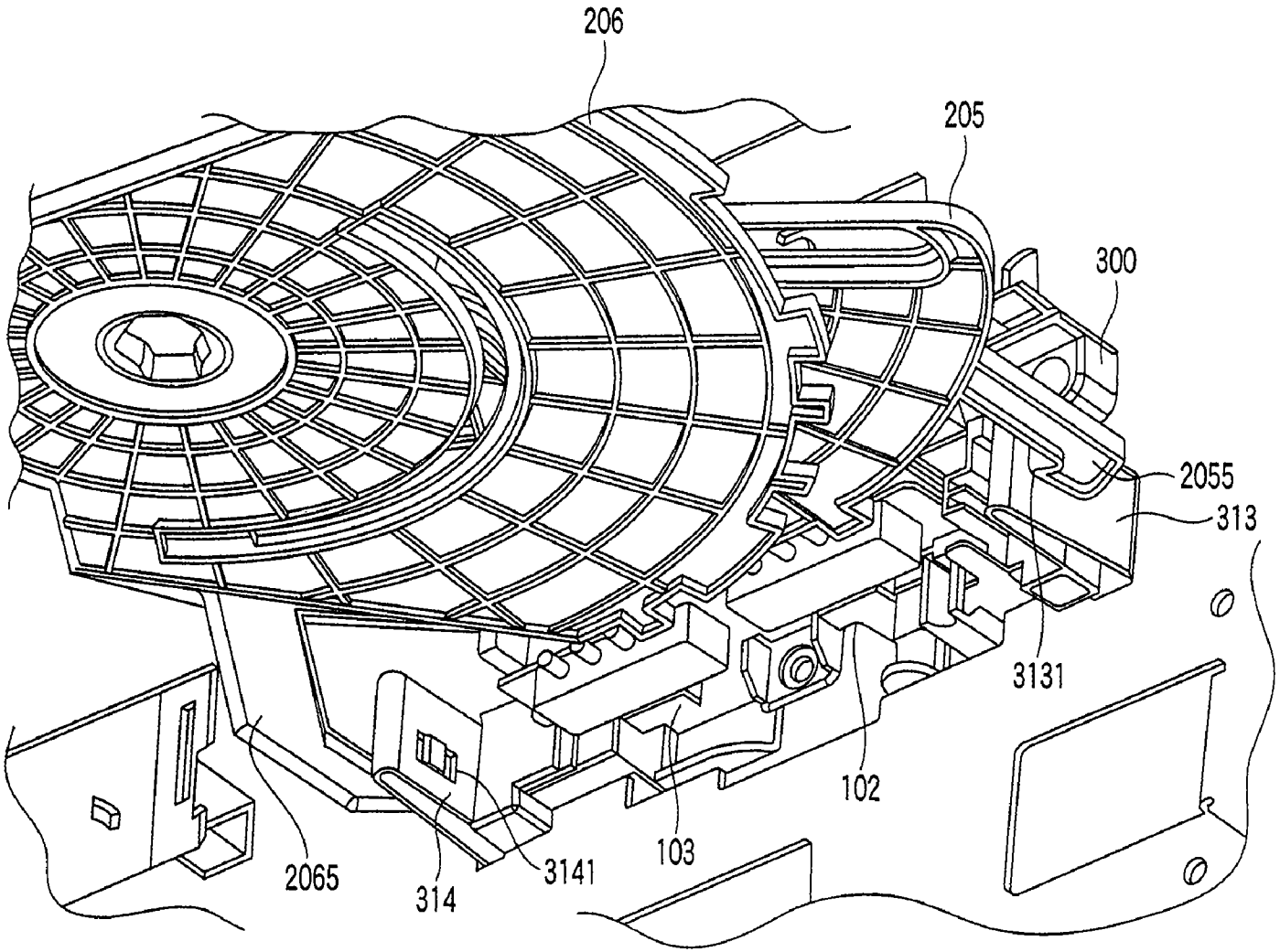
FIG. 12 is a diagram showing the structure of the sensor board according to the second embodiment.

The first sensor 102 and the second sensor 103 are arranged on the same sensor board 300 in the horizontal direction. The sensor board 300 is structurally detachably fixed and electrically connected to a housing 11 of the paper feeding apparatus 20 so as to be detachable from. The sensor board 300 is adapted to be electrically connected to the paper feeding apparatus 20. FIG. 12 shows the sensor board 300 that is held by the housing 11 of the paper feeding apparatus 20. The sensor board 300 is mounted with respect to the housing 11 from the near side of the paper feeding apparatus 20 to the depth side. The sensor board 300 has a first claw member 313 and a second claw member 314. The first claw member 313 is a plate spring that has elasticity in a direction perpendicular to the mounting direction of the sensor board 300. The second claw member 314 has the same structure as the first claw member 313. In addition, the first claw member 313 has an opening 3131 of a predetermined size. The second claw member 314 also has an opening 3141 of a predetermined size.

As shown in FIG. 12, the first movable member 205 has a first sensor board holding portion 2055 in a part of the comb-teeth member 2051, and the second movable member 206 has a second sensor board holding portion 2065 in a part of the comb-teeth member 2061.

A front end of the first sensor board holding portion 2055 is engaged with an opening 3131 provided in the first claw member 313 in a shape smaller than the opening 3131. In addition, the front end of the first sensor board holding portion 2055 is moved to a position opposed to the opening 3131 provided in the first claw member 313 by rotation of the first movable member 205. Similarly, a front end of the second sensor board holding portion 2065 is engaged with an opening 3141 provided in the second claw member 314 in a shape smaller than the opening 3141. In addition, the front end of the second sensor board holding portion 2065 is moved to a position opposed to the opening 3141 provided in the second claw member 314 by rotation of the second movable member 206.

Figure 13:
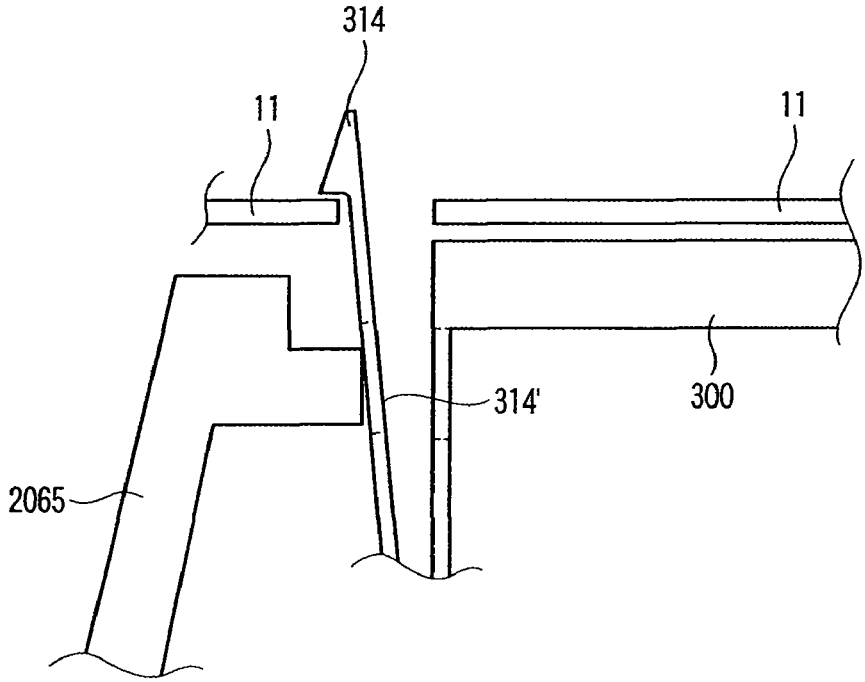
FIG. 13 is a top view showing engagement of a first movable member and a second movable member with the sensor board according to the second embodiment.

FIG. 13 shows a state where the front-side sidewall 202F, the rear-side sidewall 202R, and the end wall 204 are moved to predetermined positions, and the second sensor board holding portion 2065 is engaged with the opening 3141 provided in the second claw member 314. If the front-side sidewall 202F and the rear-side sidewall 202R are moved in the width direction of the paper cassette 201, the first movable member 205 is rotated around the shaft in accordance with the movement. For this reason, when the front-side sidewall 202F and the rear-side sidewall 202R are opened in the width direction of the paper cassette 201, as shown in FIG. 12, the first sensor board holding portion 2055 is engaged with the opening 3131 provided in the first claw member 313.

Similarly, if the end wall 204 is moved in the longitudinal direction of the paper cassette 201, the second movable member 206 is rotated around the shaft in accordance with the movement. For this reason, when the end wall 204 is opened in the longitudinal direction of the paper cassette 201, as shown in FIG. 13, the second sensor board holding portion 2065 is engaged with the opening 3141 of the first claw member 314. In addition, if the end wall 204 is opened full in the longitudinal direction of the paper cassette 201, the second sensor board holding portion 2065 bends the second claw member 314 in a direction away from the housing 11. Similarly, if the front-side sidewall 202F and the rear-side sidewall 202R are opened full in the width direction of the paper cassette 201, the first sensor board holding portion 2055 bends the second claw member 313 in a direction away from the housing 11.

Figure 14:
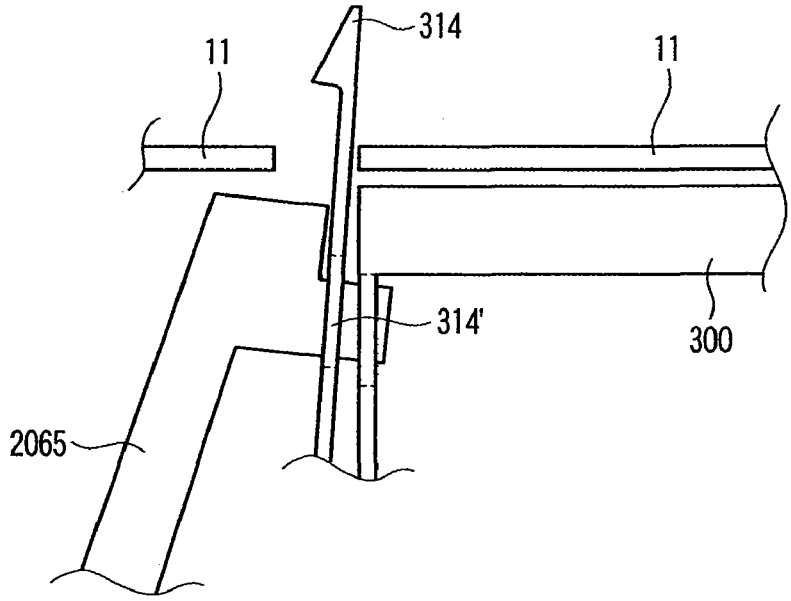
FIG. 14 is a top view showing engagement of the first movable member and the second movable member with the sensor board according to the second embodiment.
Figure 15:
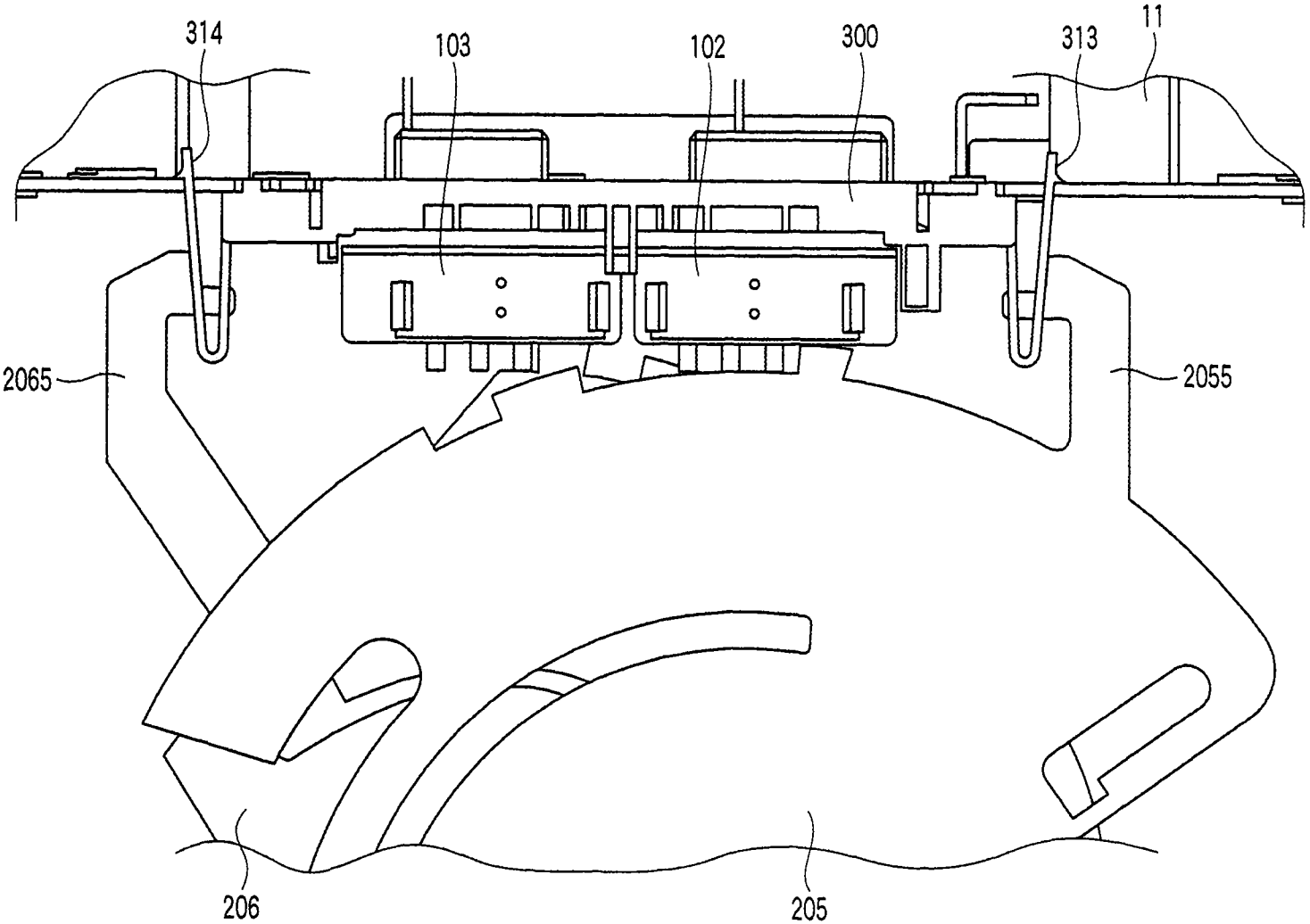
FIG. 15 is a top view showing engagement of the first movable member and the second movable member with the sensor board according to the second embodiment.
Figure 16:
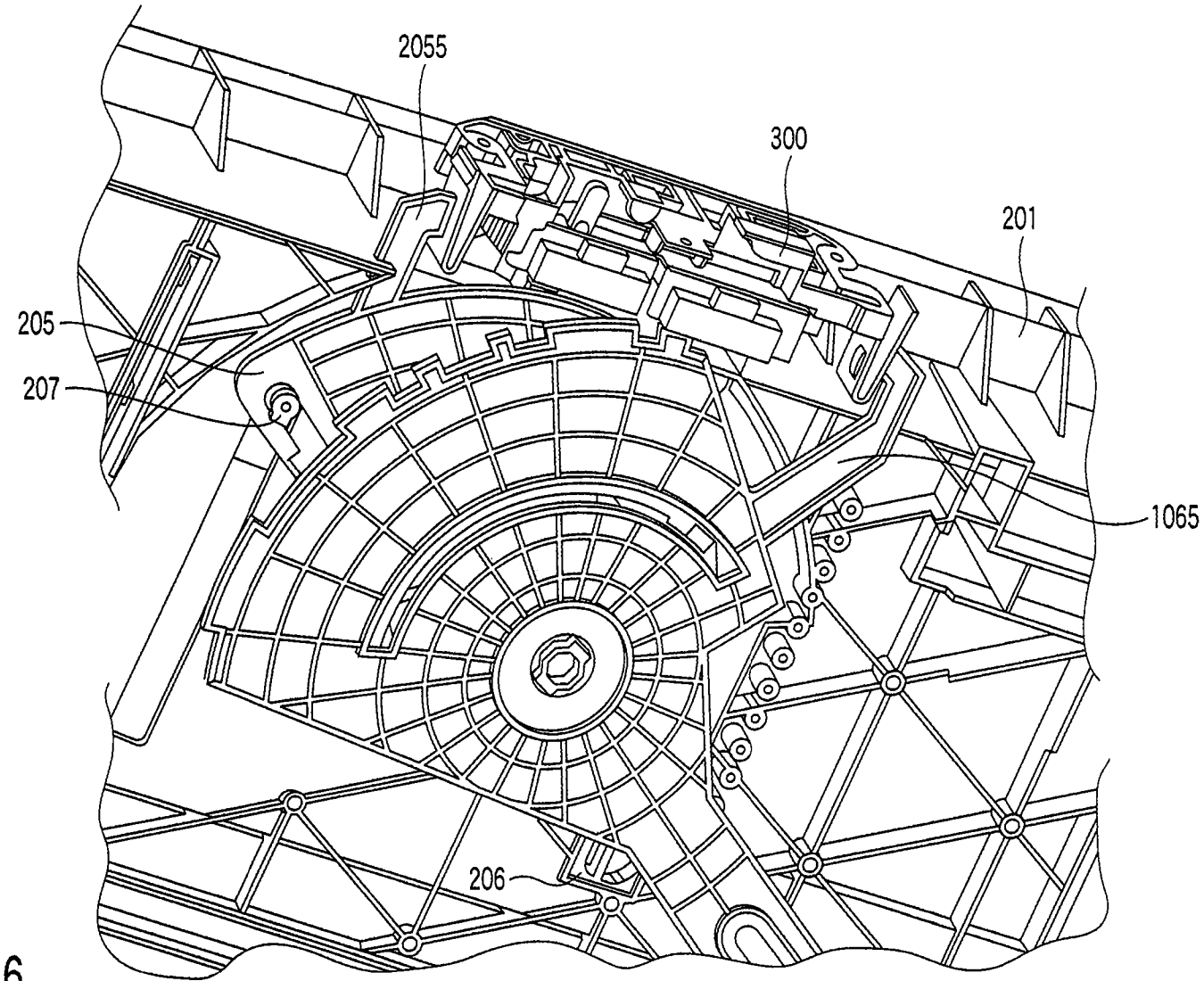
FIG. 16 is a bottom view showing engagement of the first movable member and the second movable member with the sensor board according to the second embodiment.

FIG. 15 is a diagram showing coupling of the first movable member 205 and the second movable member 206, and the sensor board 300 when viewed from the upper surface. FIG. 16 is a diagram showing coupling of the first movable member 205 and the second movable member 206, and the sensor board 300 when viewed from the lower surface. If the front-side sidewall 202F, the rear-side sidewall 202R, and the end wall 204 are moved to predetermined positions, the first sensor board holding portion 2055 is engaged with the first claw member 313, and the second sensor board holding portion 2065 is engaged with the second claw member 314. As shown in FIGS. 15 and 16, the sensor board 300 is held by the first sensor board holding portion 2055 and the second sensor board holding portion 2065. Then, as shown in FIG. 14, the sensor board 300 is spaced away from the housing 11 by the first sensor board holding portion 2055 and the second sensor board holding portion 2065.

In this state, if a serviceman draws out the paper cassette 201 from the paper feeding apparatus 20, the sensor board 300 is drawn out together with the first movable member 205 and the second movable member 206 in a state where the sensor board 300 is held by the first movable member 205 and the second movable member 206. To the contrary, if the serviceman inserts the paper cassette 201 into the image forming apparatus 1 in a state where the sensor board 300 is held by the first movable member 205 and the second movable member 206, the sensor board 300 is placed at a predetermined position in the paper feeding apparatus 20.

If the end wall 204 is in a state other than the full opened state in the longitudinal direction of the paper cassette 201, as shown in FIG. 13, the second claw member 314 returns to a hold position with respect to the housing 11. Similarly, when the front-side sidewall 202F and the rear-side sidewall 202R are in a state other than the full opened state in the width direction of the paper cassette 201, the first claw member 313 returns to a hold position with respect to the housing 11. It is easy for the serviceman to detach and attach the sensor board 300 with respect to the paper feeding apparatus 20.

Figure 17:
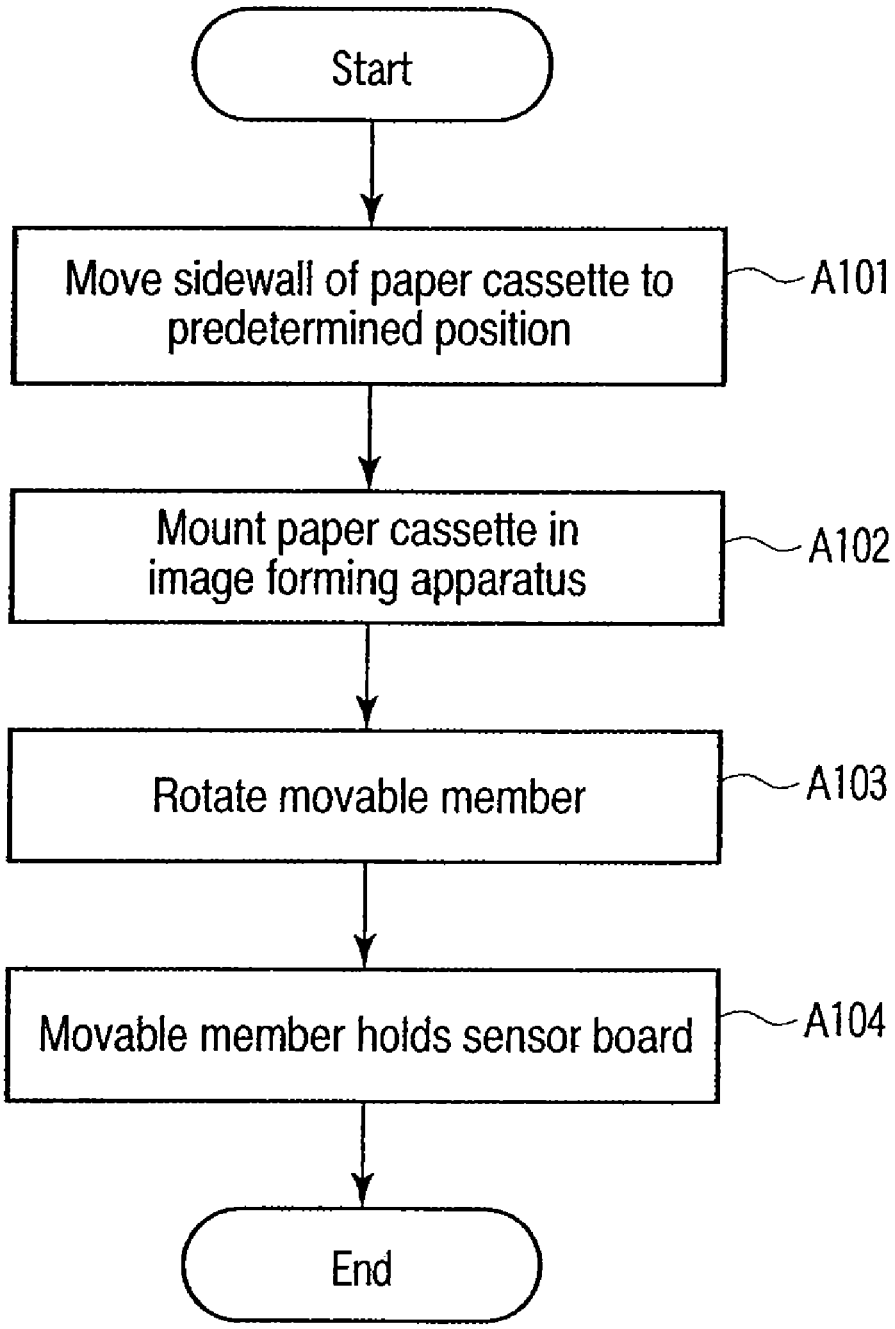
FIG. 17 is a flowchart showing detachment of the sensor board according to the second embodiment.

FIG. 17 is a flowchart showing the flow of detachment of the sensor board 300.

First, the serviceman sets the end wall 204, the front-side sidewall 202F, and the rear-side sidewall 202R of the paper cassette 201 at predetermined positions (Act 101).

Next, the serviceman mounts the paper cassette 201 in the paper feeding apparatus 20 (Act 102). The serviceman puts the end wall 204 in the full opened state in the longitudinal direction of the paper cassette 201, and puts the front-side sidewall 202F and the rear-side sidewall 202R in the full opened state in the width direction of the paper cassette 201. The first movable member 205 and the second movable member 206 rotate around the shaft (Act 103).

Since the first movable member 205 and the second movable member 206 hold the sensor board 300, the serviceman can draw out the sensor board 300 from the paper feeding apparatus 20 together with the paper cassette 201 (Act 104).

Next, a third embodiment will be described.

Figure 18:
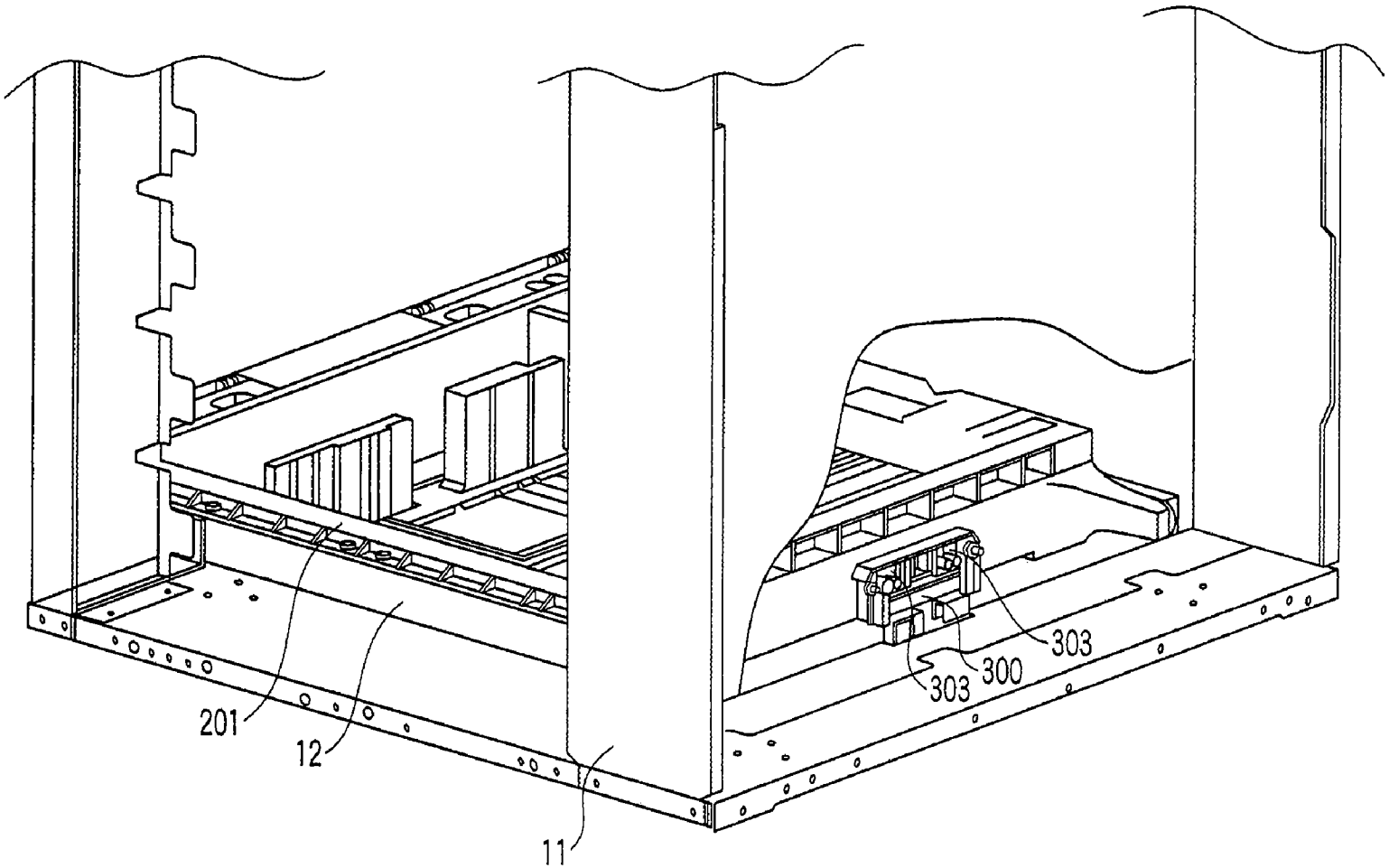
FIG. 18 is a diagram showing the structure of a sensor board according to a third embodiment.

FIG. 18 is a perspective view of the paper cassette 201 and the sensor board 300 mounted in the paper feeding apparatus 20 when viewed from the depth side of the paper feeding apparatus 20. In the paper feeding apparatus 20, guide rail members 12 for holding the paper cassette 201 mountable on the paper feeding apparatus 20 and enabling the paper cassette 201 to be drawn out from the paper feeding apparatus 20 are provided in the housing 11. The sensor board 300 is disposed on the depth side of the paper feeding apparatus 20 opposed to the paper cassette 201. The paper cassette 201 is positioned with respect to the housing 11.

Figure 19:
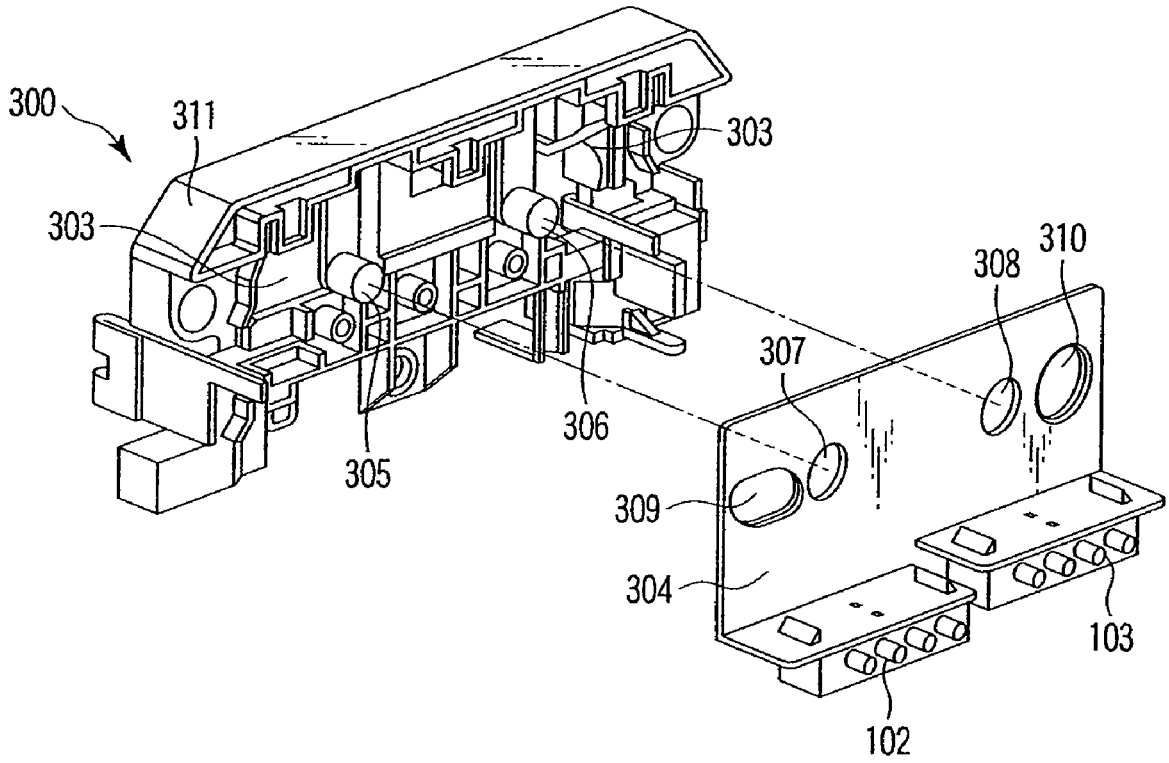
FIG. 19 is a diagram showing the structure of the sensor board according to the third embodiment.

FIG. 19 shows the structure of the sensor board 300 according to this embodiment. The sensor board 300 has a holder member 311 and a float member 304 in combination. The holder member 311 has a positioning member 303, a first holder boss 305, and a second holder boss 306. The positioning member 303 is engaged with the housing 11 of the paper feeding apparatus 20. For this reason, the absolute position of the holder member 311 with respect to the paper feeding apparatus 20 is fixed. The first holder boss 305 and the second holder boas 306 are protrusions. The float member 304 is provided with an opening 307, an opening 308, an opening 309, and an opening 310. The opening 309 has a shape extending in the horizontal direction. In the float member 304, the first sensor 102 and the second sensor 103 are provided as a single body.

Figure 20:
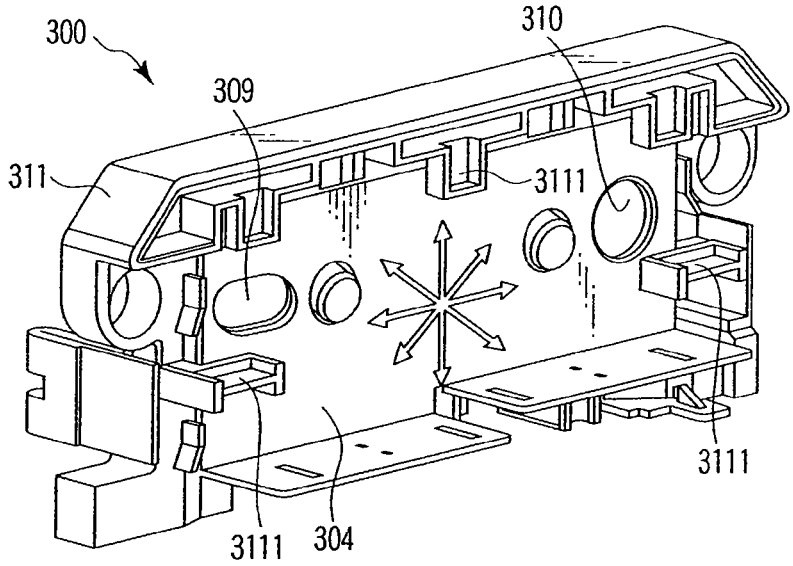
FIG. 20 is a diagram showing the structure of the sensor board according to the third embodiment.

The first holder boss 305 that is a protrusion provided in the holder member 311 is fitted into the opening 307 of the float member 304. The second holder boss 306 that is a protrusion provided in the holder member 311 is fitted into the opening 308 of the float member 304. The opening 307 and the opening 308 have a diameter larger than those of the first holder boss 305 and the second holder boss 306, respectively. Therefore, the float member 304 has a degree of freedom with respect to the holder member 311. As shown in FIG. 20, the float member 304 is fixed by a plurality of fixing portions 3111 provided in the holder member 311, and the movement of the float member 304 in the front-back direction is limited. Therefore, the float member 304 that is made of a plate has a degree of freedom in the holder member 311 in a direction indicated by an arrow in the drawing.

Figure 21:
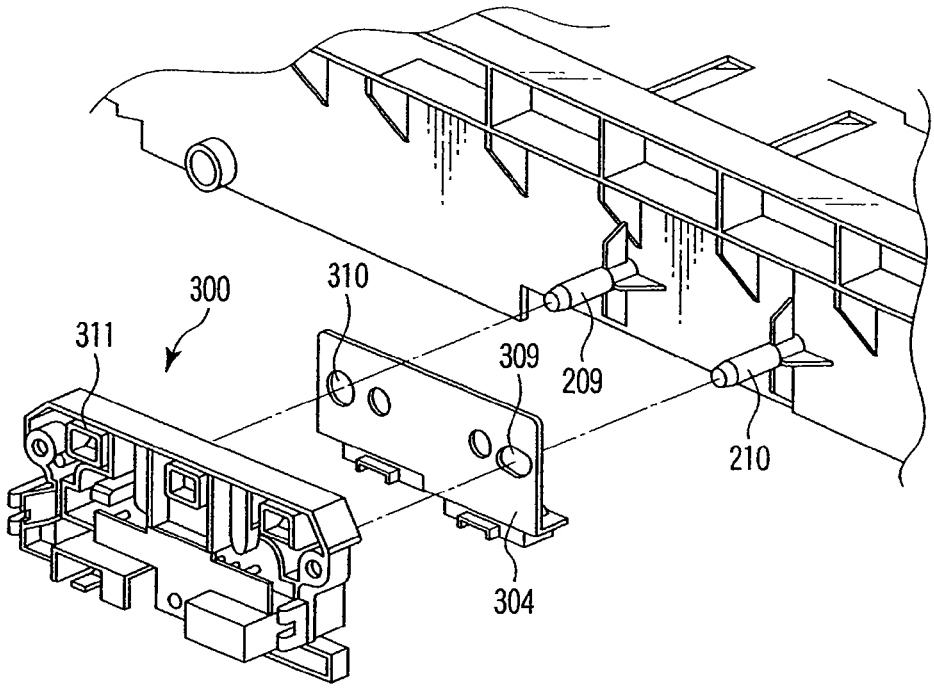
FIG. 21 is a diagram showing the structure of a paper cassette to be coupled to the sensor board according to the third embodiment.

FIG. 21 is a diagram showing the rear surfaces of the sensor board 300 and the paper cassette 201. On a surface of the paper cassette 201 opposed to the sensor board 300, a first boss 209 and a second boss 210 protrude in an extension direction. The float member 304 has at least openings corresponding to or more than the number of bosses provided in the paper cassette 201. The first boss 209 is fitted into the opening 310 provided in the float member 304. The second boss 210 is fitted into the opening 309 provided in the float member 304. The first boss 209 and the second boss 210 have a slim shape along the extension direction so as to be easily guided to the opening 310 and the opening 309, respectively. The opening 310 and the opening 309 are purled such that the first boss 209 and the second boss 210 are easily fitted thereinto.

If the paper cassette 201 is inserted with the sensor board 300 fixed to the housing 11 of the paper feeding apparatus 20, the first boss 209 and the second boss 210 are individually fitted into the opening 310 and the opening 309 of the sensor board 300. The opening 310 and the opening 309 are provided in the float member 304. In the float member 304, the first sensor 102 and the second sensor 103 are provided as a single body.

Figure 22:
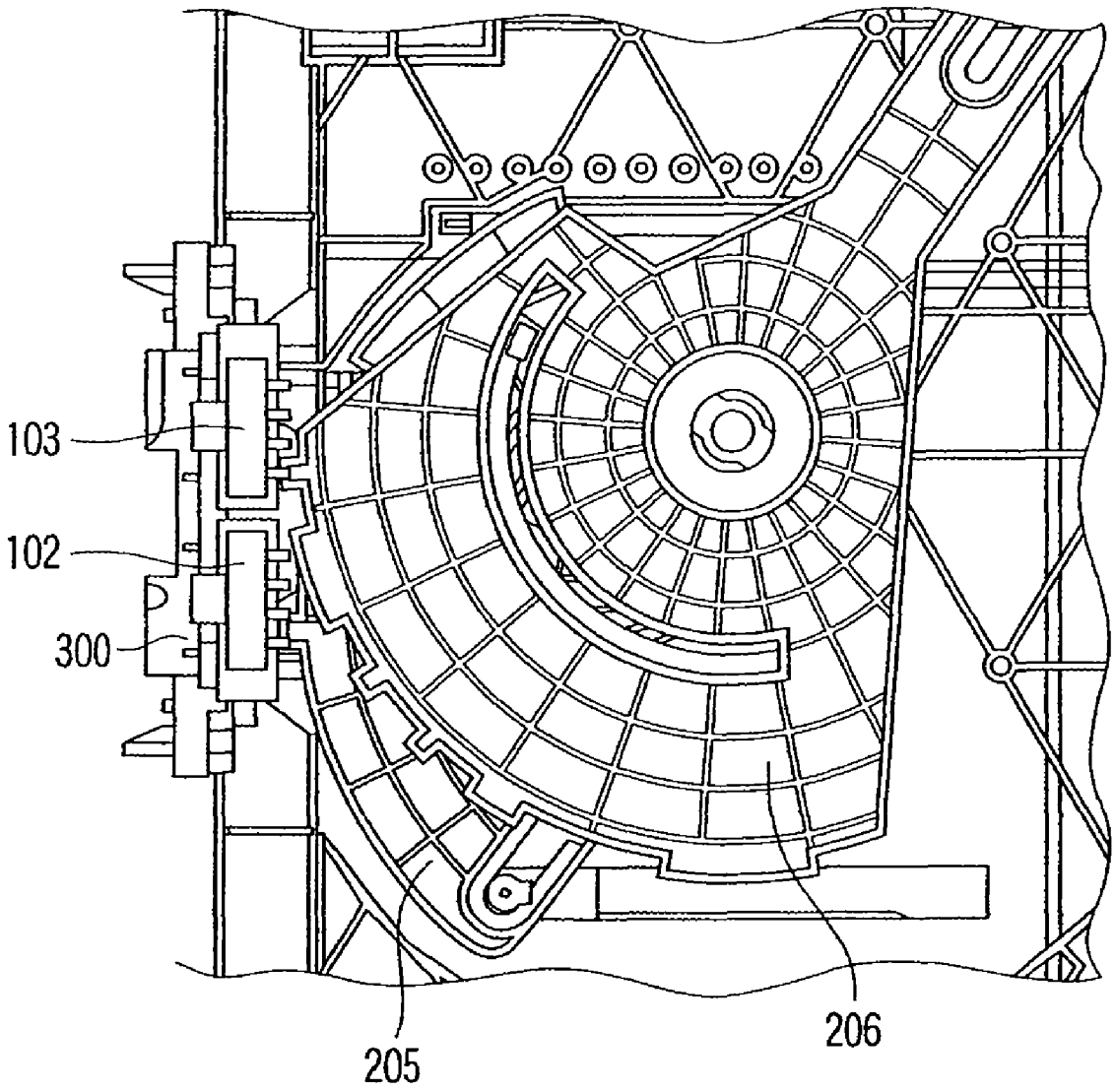
FIG. 22 is a diagram showing a state where the sensor board according to the third embodiment and the paper cassette are coupled to each other.

Therefore, as shown in FIG. 22, the first movable member 205 and the second movable member 206 provided in the paper cassette 201 are constantly accurately opposed to the first sensor 102 and the second sensor 103, respectively. That is, the relative positional relationship between the first movable member 205 and the first sensor 102 and the relative positional relationship between the second movable member 206 and the second sensor 103 are constantly uniform by the float member 304. The correlation of the first movable member 205 and the first sensor 102, and the correlation of the second movable member 206 and the second sensor 103 are secured. Therefore, there is no case where the first sensor 102 and the second sensor 103 perform erroneous detection.

The first boss 209 provided in the paper cassette 201 is fitted into the opening 310 to position the float member 304. The second boss 210 provided in the paper cassette 201 is fitted into the opening 309 to position the float member 304 in the vertical direction and to suppress rotation of the float member 304.

In the related art, the first sensor 102 and the second sensor 103 are fixed to the housing 11. For this reason, the first movable member 205 and the first sensor 102 and the second movable member 206 and the second sensor 103 have a variation in the relative positional relationship due to a cumulative tolerance, assembling accuracy, and part accuracy caused by a lot of parts between parts in contact with each other.

According to the sensor board 300 of this embodiment, the relative positions of the first sensor 102 and the second sensor 103 are reliably determined with respect to the paper cassette 201 by an inexpensive and simple method. For this reason, it is possible to avoid erroneous detection due to misalignment of the first sensor 102 and the second sensor 103.

The first boss 209 and the second boss 210 are individually fitted into the opening 310 and the opening 309 provided in the float member 304. Therefore, with the degree of freedom of the float member 304, the paper cassette 201 can be easily inserted and drawn out. As a result, the user's operational load in inserting and drawing out the paper cassette 201 is reduced.

Next, a fourth embodiment will be described.

Figure 23:
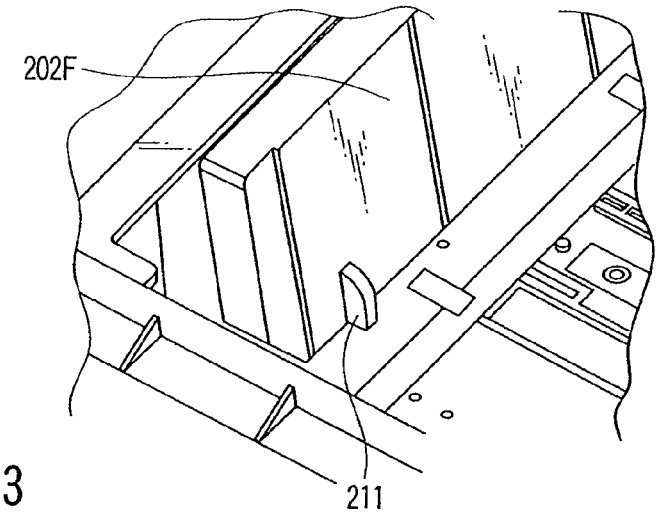
FIG. 23 is a diagram showing a paper sensor provided at a front-side sidewall according to a fourth embodiment.
Figure 24:
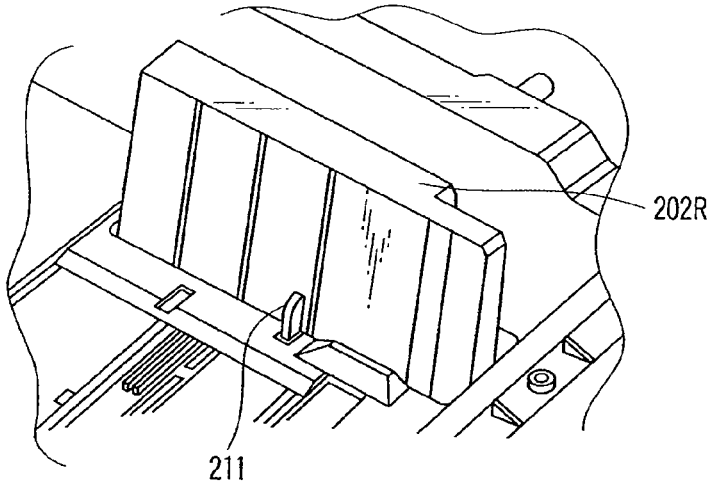
FIG. 24 is a diagram showing the paper sensor provided at a rear-side sidewall according to the fourth embodiment.
Figure 25:
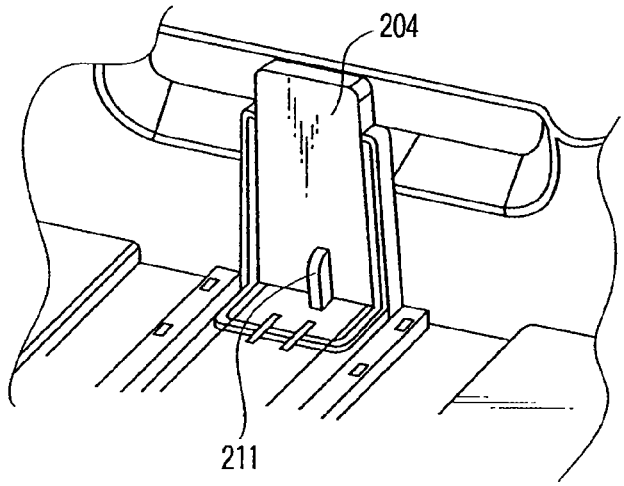
FIG. 25 is a diagram showing the paper sensor provided at an end wall according to the fourth embodiment.

FIG. 23 is an enlarged view of the front-side sidewall 202F in the paper cassette 201 shown in FIG. 3. FIG. 24 is an enlarged view of the rear-side sidewall 202R in the paper cassette 201 shown in FIG. 3. FIG. 25 is an enlarged view of the end wall 204 in the paper cassette 201 shown in FIG. 3.

As shown in FIGS. 23, 24, and 25, paper sensors 211 are individually provided on the wall surfaces near at least one of the front-side sidewall 202F, the rear-side sidewall 202R, and the end wall 204. As the paper sensors 211, for example, an actuator is used. If the front-side sidewall 202F and the rear-side sidewall 202R are moved in accordance with the size of the paper stacked in the paper cassette 201, the paper sensors 211 are in contact with the paper, and the CPU 3 determines that the front-side sidewall 202F and the rear-side sidewall 202R are moved to positions to come into contact with the paper. The same is applied to the paper sensor 211 provided on the end wall 204. The paper sensors 211 may be a non-contact sensor, for example, a reflection-type sensor or a distance measurement sensor.

Even though the CPU 3 determines the paper size from the detection results of the first sensor 102 and the second sensor 103, when the paper sensors 211 determine paper absence, the CPU 3 determines that a paper of a different size (small size) from the paper size detected from the combination of the detection results of the first sensor 102 and the second sensor 103 is stacked. The CPU 3 displays on the control panel 40 serving as a notification unit a purport to urge the user to correctly set the front-side sidewall 202F and the rear-side sidewall 202R or the end wall 204.

With the above configuration, the user can reliably set the front-side sidewall 202F and the rear-side sidewall 202R or the end wall 204 for the paper stacked in the paper cassette 201. Therefore, the paper size detected by the CPU 3 from the combination of the detection results of the first sensor 102 and the second sensor 103 is consistent with the size of the paper stacked in the paper cassette 201.

A description will now be provided for a case where the user stacks a paper of an irregular size in the paper cassette 201, and reliably sets the front-side sidewall 202F and the rear-side sidewall 202R, and the end wall 204 for the paper. The RAM 5 records combinations of detection patterns of the first sensor 102 and the second sensor 103 in advance. Then, the CPU 3 discriminates the paper size by comparing the combination of detection patterns of the first sensor 102 and the second sensor 103 and size associated information in which combinations of detection patterns recorded in the RAM 5 are associated with paper sizes. The irregular size refers to a paper size that the CPU 3 cannot discriminate by comparison of the combination of the detection patterns of the first sensor 102 and the second sensor 103 with information recorded in the RAM 5.

Therefore, when the CPU 3 determines that the detection results of the first sensor 102 and the second sensor 103 are not associated with information recorded in the RAM 5 (not a regular size), the CPU 3 displays on the control panel 40 a purport that the paper size cannot be discriminated.

The user inputs the paper size in accordance with the display on the control panel 40. The CPU 3 records the input paper size in the RAM 5 in association with the combination of detection patterns of the first sensor 102 and the second sensor 103. Thereafter, if the user stacks a paper of a corresponding size in the paper cassette 201, and reliably sets the front-side sidewall 202F and the rear-side sidewall 202R, and the end wall 204 for the paper, the CPU 3 can reliably detect the paper size by comparing the combination of detection patterns of the first sensor 102 and the second sensor 103 with information recorded in the RAM 5. Therefore, as described above, if the user inputs a paper size at one time, when the user stacks a paper of an irregular size in the paper cassette 201, it is not necessary for the control panel 40 to set the paper size.

Figure 26:
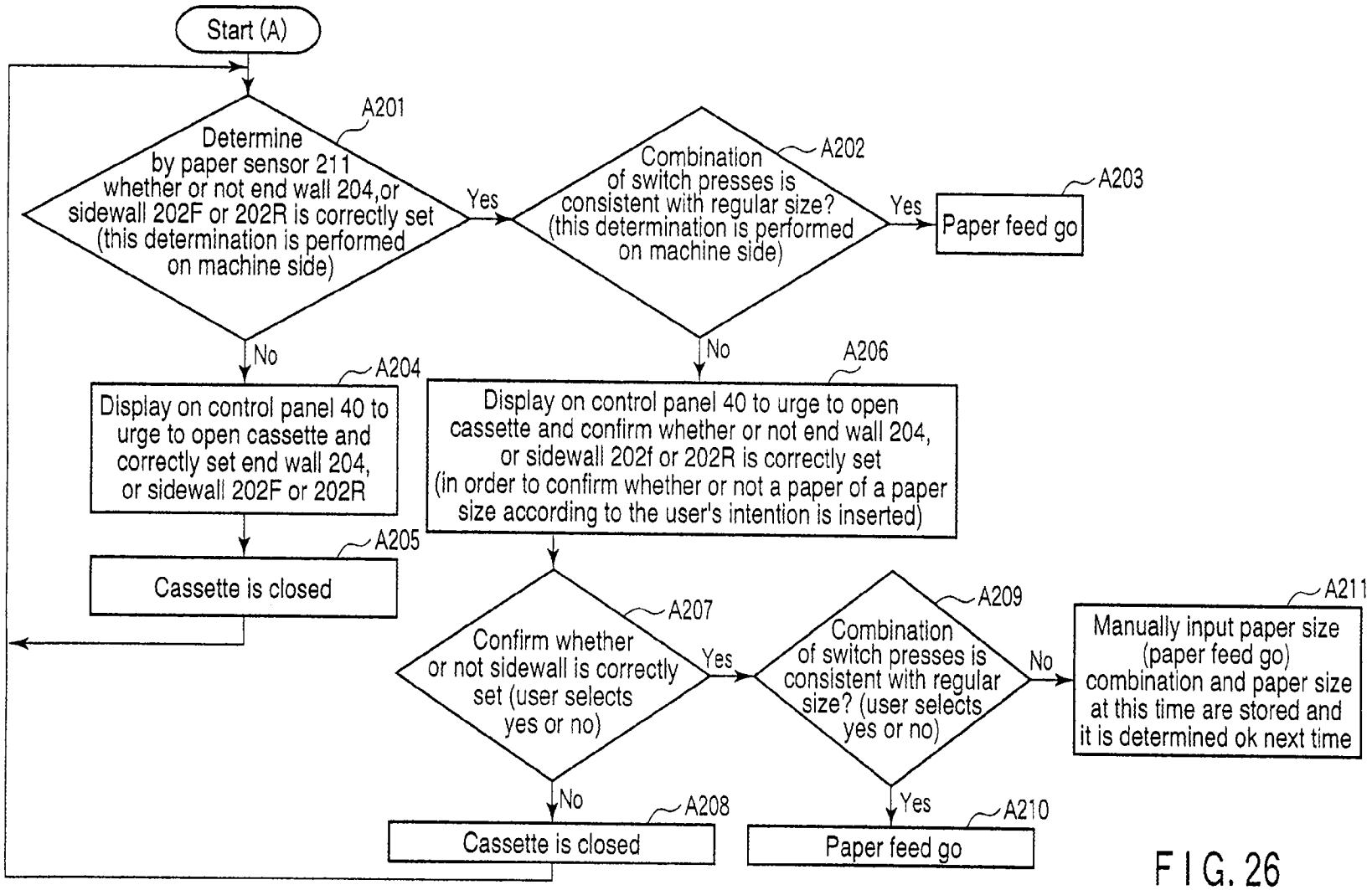
FIG. 26 is a flowchart showing paper size detection by the paper sensor according to the fourth embodiment.

FIG. 26 is a flowchart collectively showing the flow of this process.

First, the user stacks a paper in the paper cassette 201 and moves the front-side sidewall 202F, the rear-side sidewall 202R, and the end wall 204 in accordance with the paper size. The paper sensors 211 attached at predetermined positions of the end wall 204, the front-side sidewall 202F, and the rear-side sidewall 202R detect whether or not a paper is present therearound, and determines whether or not the front-side sidewall 202F, the rear-side sidewall 202R, and the end wall 204 are set in accordance with the paper size (Act 201).

If the paper sensors 211 determine that the end wall 204 (or the front-side sidewall 202F and the rear-side sidewall 202R) are correctly set (Act 201, YES), the CPU 3 determines whether or not a combination of detection patterns of the first sensor 102 and the second sensor 103 is associated with information on paper size recorded in the RAM 5 (Act 202).

When the CPU 3 can discriminate the paper size (Act 202, YES), the CPU 3 conveys the paper by the paper feed rollers 101 driven by a paper feed roller motor 400 (Act 203).

If the paper sensor 211 determines that the end wall 204 (or the front-side sidewall 202F and the rear-side sidewall 202R) are not correctly set (Act 201, NO), the CPU 3 displays on the control panel 40 a purport to urge the user to correctly set the end wall 204 (or the front-side sidewall 202F and the rear-side sidewall 202R) in accordance with the paper (Act 204).

After the paper cassette 201 is drawn out from the paper feeding apparatus 20, if the CPU 3 determines that the paper cassette 201 is inserted into the paper feeding apparatus 20 again (Act 205), the process returns to Act 201.

When the paper size cannot be discriminated (Act 202, NO), the CPU 3 displays on the control panel 40 a purport that a paper of an irregular size is stacked (Act 206). That is, the user can draw out the paper cassette 201 to confirm whether or not the size of the paper stacked in the paper cassette 201 is an intended size.

The user draws out the paper cassette 201, determines that the end wall 204 (or the front-side sidewall 202F and the rear-side sidewall 202R) are not correctly set in accordance with the paper, selects NO (Act 207, NO), and correctly sets the end wall 204 (or the front-side sidewall 202F and the rear-side sidewall 202R). Then, if it is determined that the paper cassette 201 is inserted into the paper feeding apparatus 20 again (Act 208), the process returns to Act 201.

When the user draws out the paper cassette 201 and determines that the end wall 204 (or the front-side sidewall 202F and the rear-side sidewall 202R) are correctly set in accordance with the paper (Act 207, YES), if the CPU 3 determines that the paper size is not correct (Act 209, NO), the user inputs the paper size in accordance with the display on the control panel 40 (Act 211). The CPU 3 records the input paper size in the RAM 5 in association with a combination of detection patterns of the first sensor 102 and the second sensor 103 (Act 211). If the CPU 3 determines that the paper size is correct (Act 209, YES), the CPU 3 conveys the paper by the paper feed rollers 101 driven by the paper feed roller motor 400 (Act 210).

With this configuration, when a paper of a size different from the paper size determined by the CPU 3 is stacked in the paper cassette 201, an error is displayed on the control panel 40. Therefore, a paper of a different size is not conveyed to the image forming unit 10. As a result, in the image forming unit 10, it is possible to prevent paper jam or deterioration in printing position accuracy from occurring due to a difference in paper size.

Figure 27:
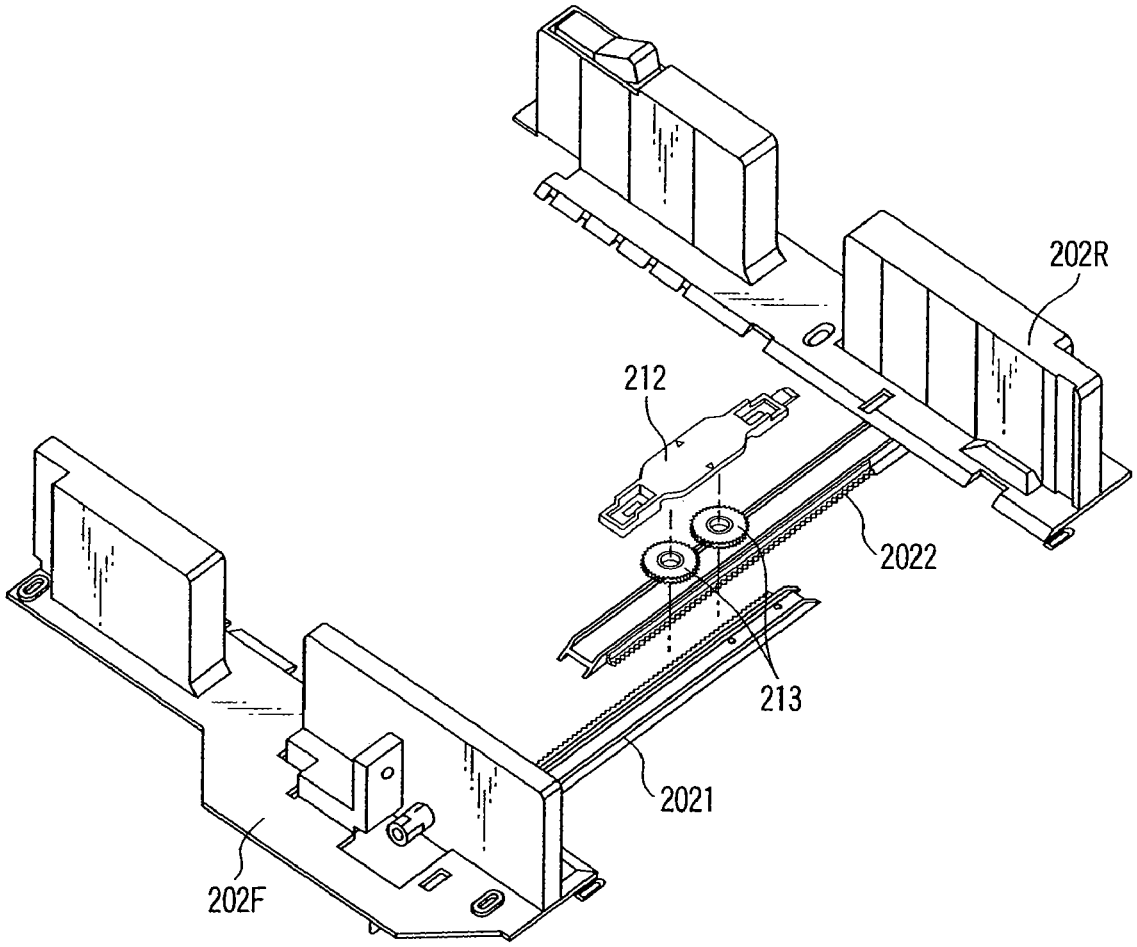
FIG. 27 is a top perspective view showing a part of a paper cassette according to a fifth embodiment.

Next, a fifth embodiment will be described. FIG. 27 is a top perspective view of a part of the paper cassette 201 shown in FIG. 3. Here, the front-side sidewall 202F has a front-side rack portion 2021 that has a predetermined length in the width direction of the paper cassette 201. The rear-side sidewall 202R has a rear-side rack portion 2022 that has a predetermined length in the width direction of the paper cassette 201. The front-side rack portion 2021 and the rear-side rack portion 2022 are arranged in parallel to be spaced at a predetermined interval from each other. Two pinion gears 213 are disposed between the front side rack portion 2021 and the rear-side rack portion 2022. In order to fix the pinion gears 213, a pinion gear holding member 212 serving as a position correction member is disposed on the upper surface of the pinion gear 213 and fixed to the paper cassette 201.

Figure 28:
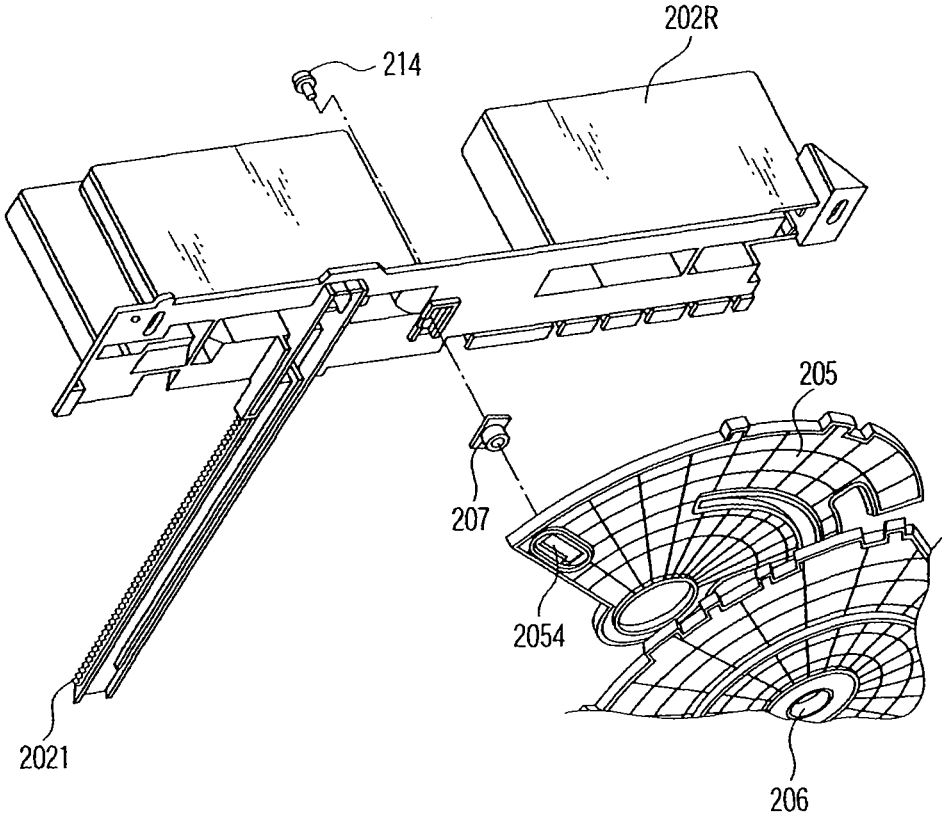
FIG. 28 is a diagram showing coupling of the rear-side sidewall and the first movable member according to the fifth embodiment.
Figure 29:
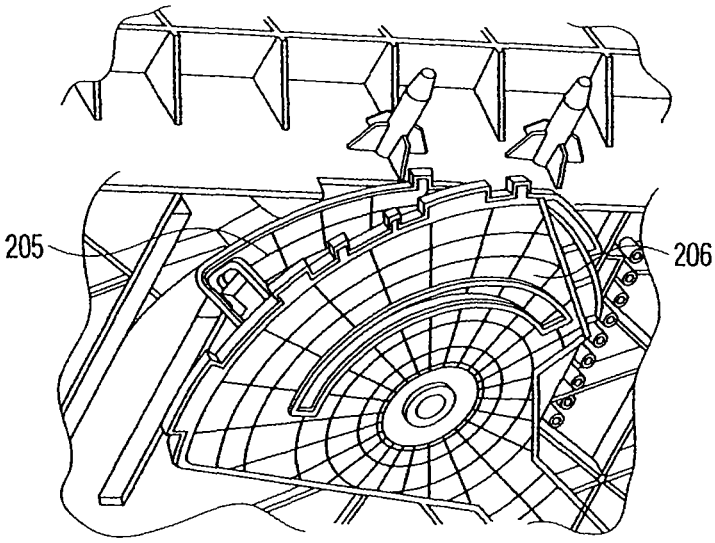
FIG. 29 is a diagram showing coupling of the rear-side side wall and the first movable member according to the fifth embodiment.

FIGS. 28 and 29 show connection of the rear-side sidewall 202R and the first movable member 205 when viewed from the rear surface of the paper cassette 201. To the rear-side sidewall 202R, a first connection member 207 that protrudes toward the rear surface of the paper cassette 201 is fixed by a screw 214. The first connection member 207 is fitted into a second joint groove 2054 provided in the first movable member 205. Accordingly, the first movable member 205 is rotated around the shaft in accordance with the operation of the first connection member 207 by movement of the rear-side sidewall 202R in the width direction of the paper cassette 201.

Figure 30:
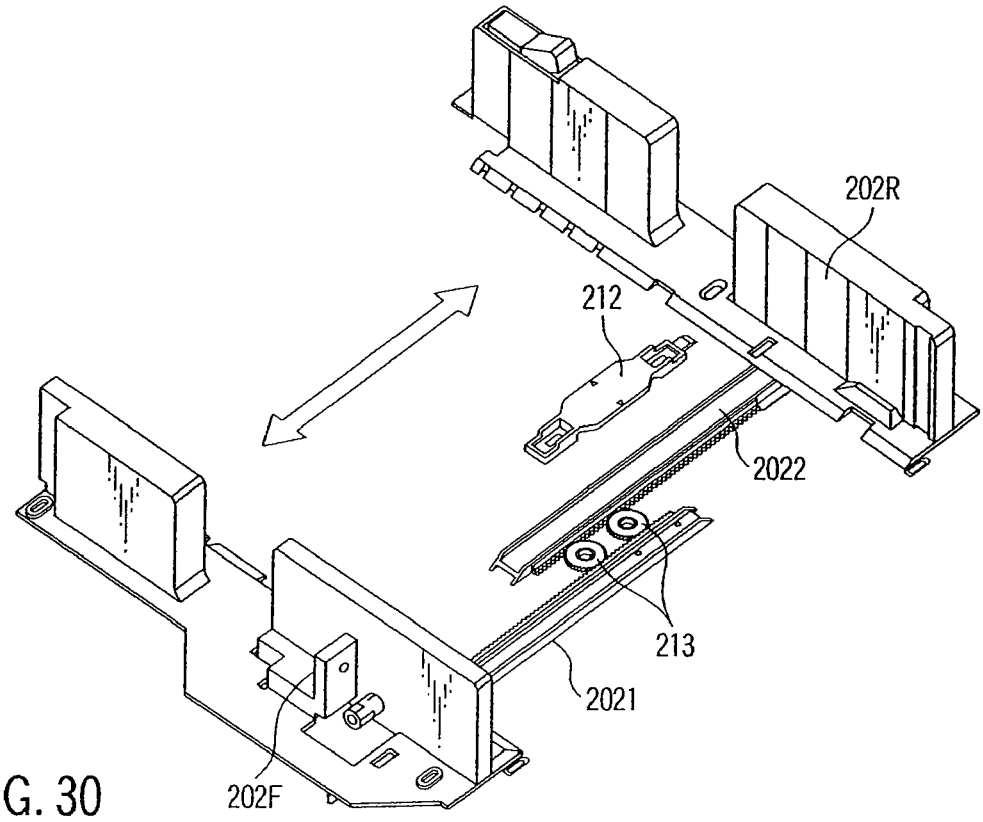
FIG. 30 is a diagram showing the stretched state of a front-side sidewall and the rear-side sidewall according to the fifth embodiment.
Figure 31:
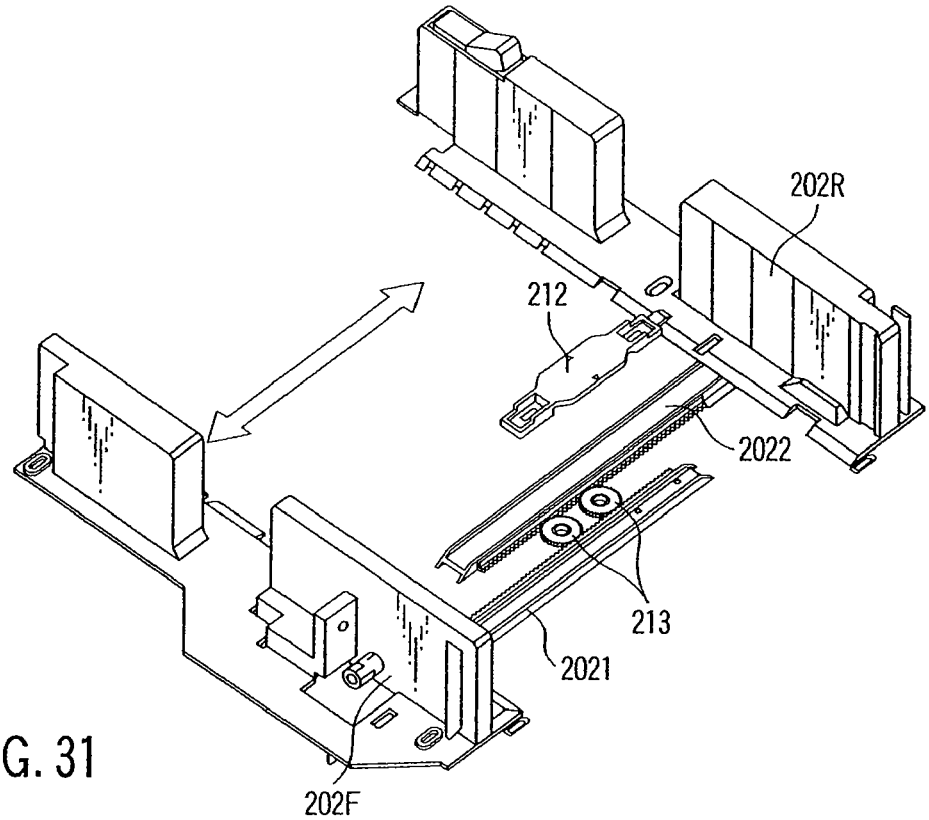
FIG. 31 is a diagram showing the retracted state of the front-side sidewall and the rear-side sidewall according to the fifth embodiment.

FIG. 30 is a diagram showing a state the front-side sidewall 202F and the rear-side sidewall 202R are stretched in the width direction of the paper cassette 201. FIG. 31 is a diagram showing a case where the front-side sidewall 202F and the rear-side sidewall 202R are retracted in the width direction of the paper cassette 201. The two pinion gears 213 are disposed between the front-side rack portion 2021 and the rear-side rack portion 2022. In the front-side rack portion 2021 and the rear-side rack portion 2022, grooves are provided at a regular interval on opposing sides along the longitudinal direction. The pinion gears 213 are fitted between the front-side rack portion 2021 and the rear-side rack portion 2022. Grooves that are provided in the outer peripheral surfaces of the pinion gears 213 at a regular interval are meshed with the groove in the front-side rack portion 2021 and the groove in the rear-side rack portion 2022. The pinion gears 213 are fixed to the paper cassette 201 by the pinion gear holding member 212. Therefore, the positional relationship between the pinion gears 213 and the paper cassette 201 are fixed. As a result, if the front-side sidewall 202F moves in the width direction, the rear-side sidewall 202R also moves from the center axis of the paper tray 20 in the longitudinal direction by the same interval as the movement interval of the front-side sidewall 202F through the pinion gears 213.

Figure 32:
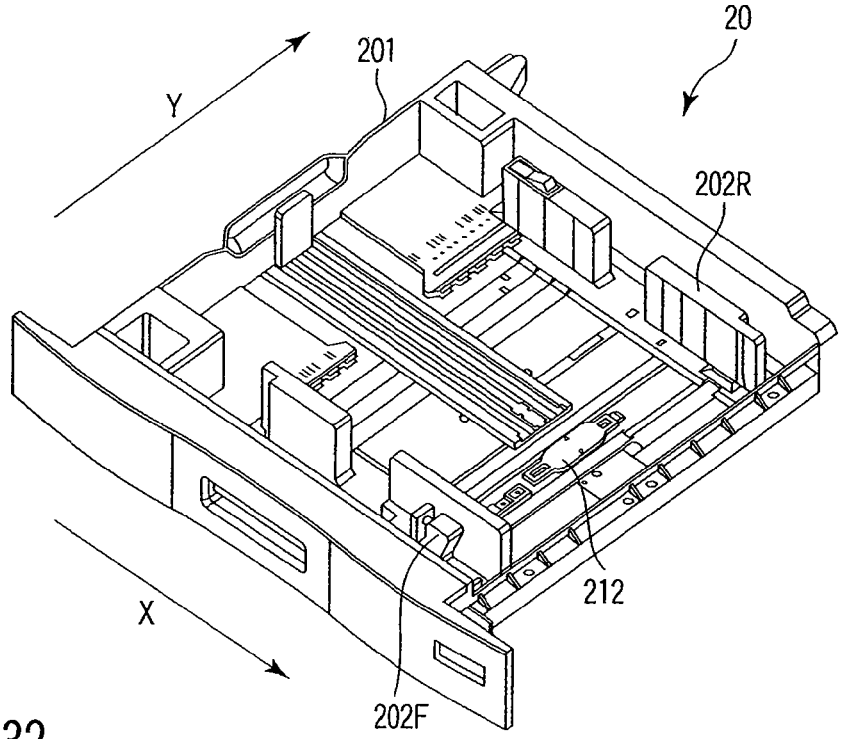
FIG. 32 is a top perspective view showing the paper cassette according to the fifth embodiment.
Figure 33:
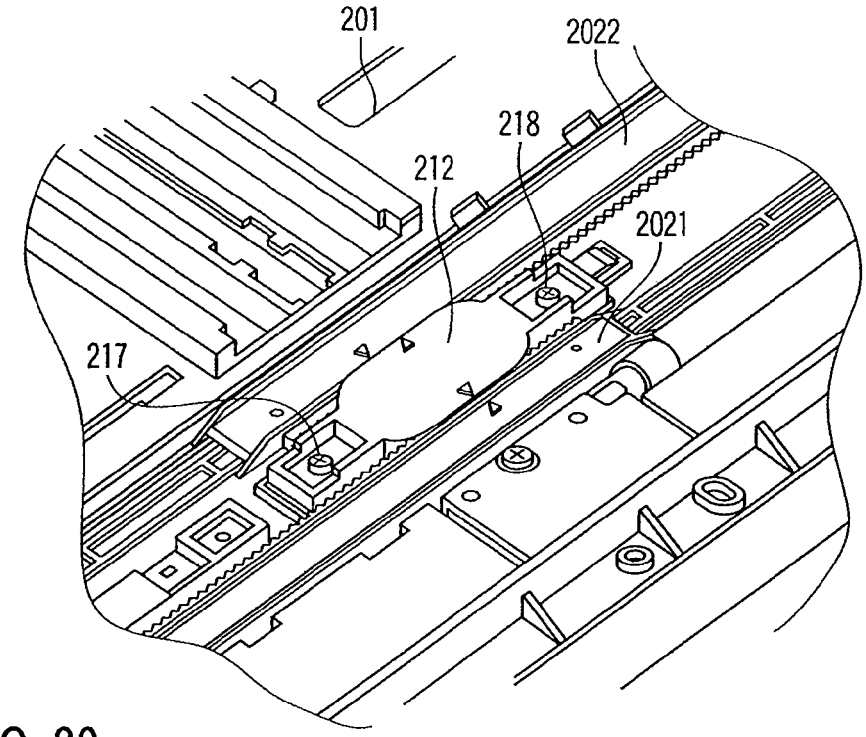
FIG. 33 is a diagram showing a pinion gear mounted on the paper cassette according to the fifth embodiment.
Figure 34:
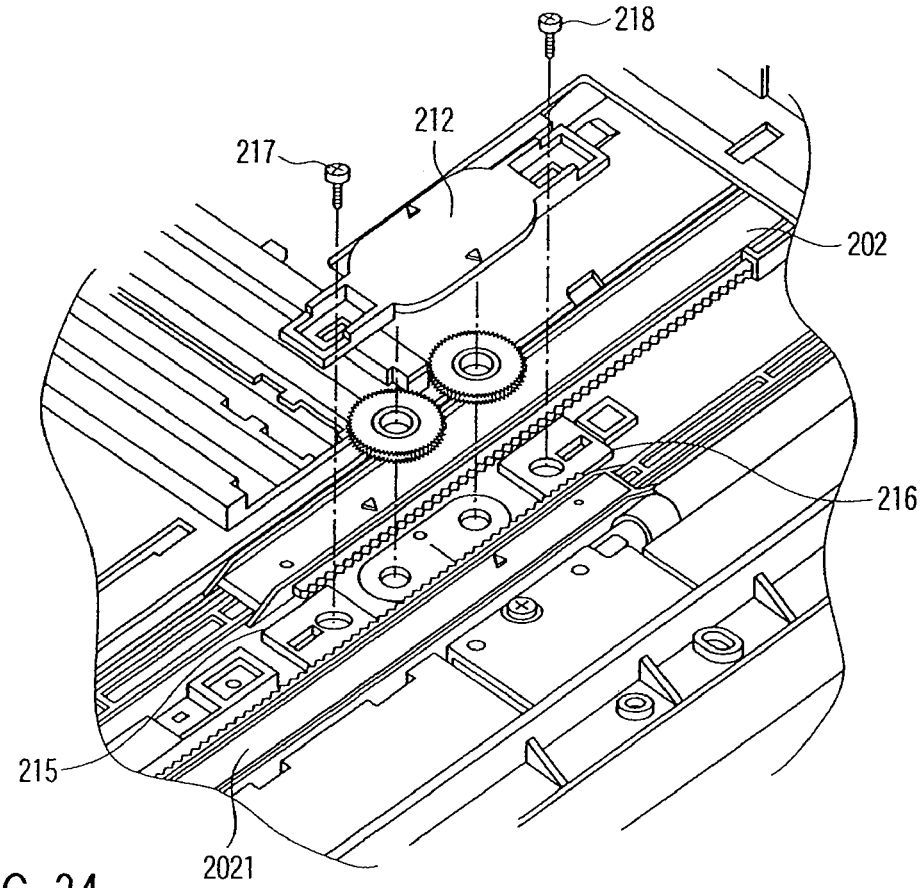
FIG. 34 is a diagram showing the pinion gear before being mounted on the paper cassette according to the fifth embodiment.
Figure 35:
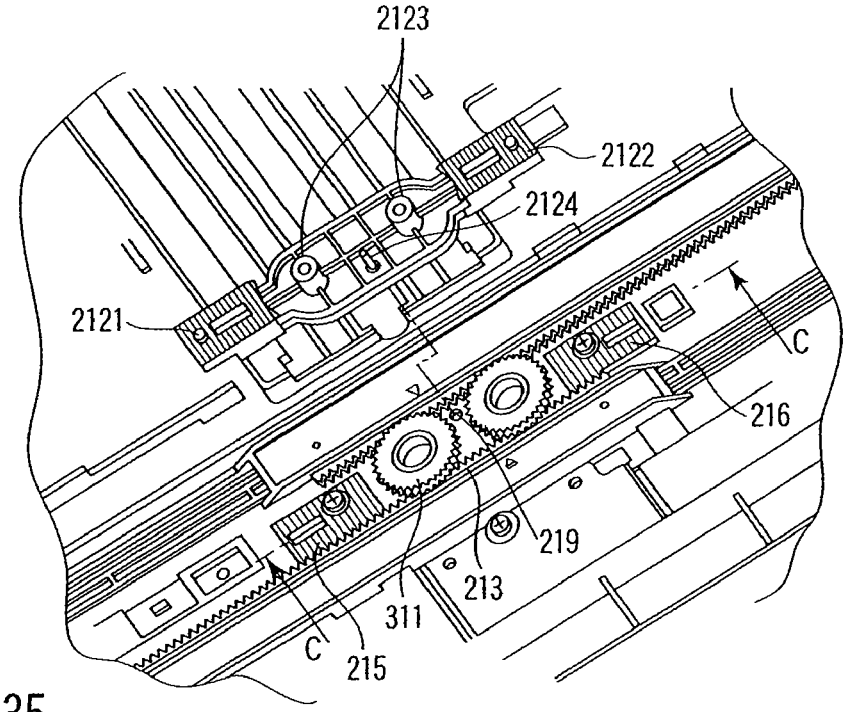
FIG. 35 is a diagram showing the rear surface of a pinion gear holding member according to the fifth embodiment.

FIG. 32 is a top perspective view of the paper cassette 201. FIG. 33 is a diagram showing the paper cassette 201 in a state where the pinion gears 213 and the pinion gear holding member 212 are mounted in the paper cassette 201. FIG. 34 is a diagram of the paper cassette 201 when the pinion gears 213 and the pinion gear holding member 212 are disassembled from the paper cassette 201. FIG. 35 is a diagram showing a state where the pinion gears 213 are mounted in the paper cassette 201, and a surface (rear surface) of the pinion gear holding member 212 opposed to the paper cassette 201.

In the paper cassette 201 sandwiched between the front-side rack portion 2021 and the rear-side rack portion 2022, a first fixing portion 215 and a second fixing portion 216 are provided to be spaced at a predetermined interval from each other in the width direction of the paper cassette 201. The first fixing portion 215 is provided at a position near the front-side sidewall 202F. The second fixing portion 216 is provided at a position near the rear-side sidewall 202R. In the first fixing portion 215 and the second fixing portion 216, grooves are provided at a regular interval (here, 1 mm) along the width direction of the paper cassette 201.

On the rear surface of the pinion gear holding member 212, as shown in FIG. 35, a first correction member 2121 is provided to be opposed to the first fixing portion 215 provided in the paper cassette 201. In addition, on the rear surface of the pinion gear holding member 212, a second correction member 2122 is provided to be opposed to the second fixing portion 216 provided in the paper cassette 201. In the first correction member 2121 and the second correction member 2122, grooves are formed at a regular interval (here, 1 mm) along the width direction of the paper cassette 201 when being mounted in the paper cassette 201.

On the rear surface of the pinion gear holding member 212, two holding protrusions 2123 are provided between the first correction member 2121 and the second correction member 2122 along the width direction of the paper cassette 201 when being mounted in the paper cassette 201. The two holding protrusions 2123 provided in the pinion gear holding member 212 hold the pinion gears 213, respectively, when the pinion gear holding member 212 is mounted in the paper cassette 201. In addition, on the rear surface of the pinion gear holding member 212, a position fixing protrusion 2124 is provided at the center in the width direction of the paper cassette 201 when being mounted in the paper cassette 201. The position fixing protrusion 2124 provided in the pinion gear holding member 212 is fitted into a fixing hole 219 when the pinion gear holding member 212 is mounted in the paper cassette 201. The first correction member 2121 of the pinion gear holding member 212 is fastened to the opposing first fixing portion 215 by a screw 217. Similarly, the second correction member 2122 of the pinion gear holding member 212 is fastened to the opposing second fixing portion 216 by a screw 218.

Figure 36:
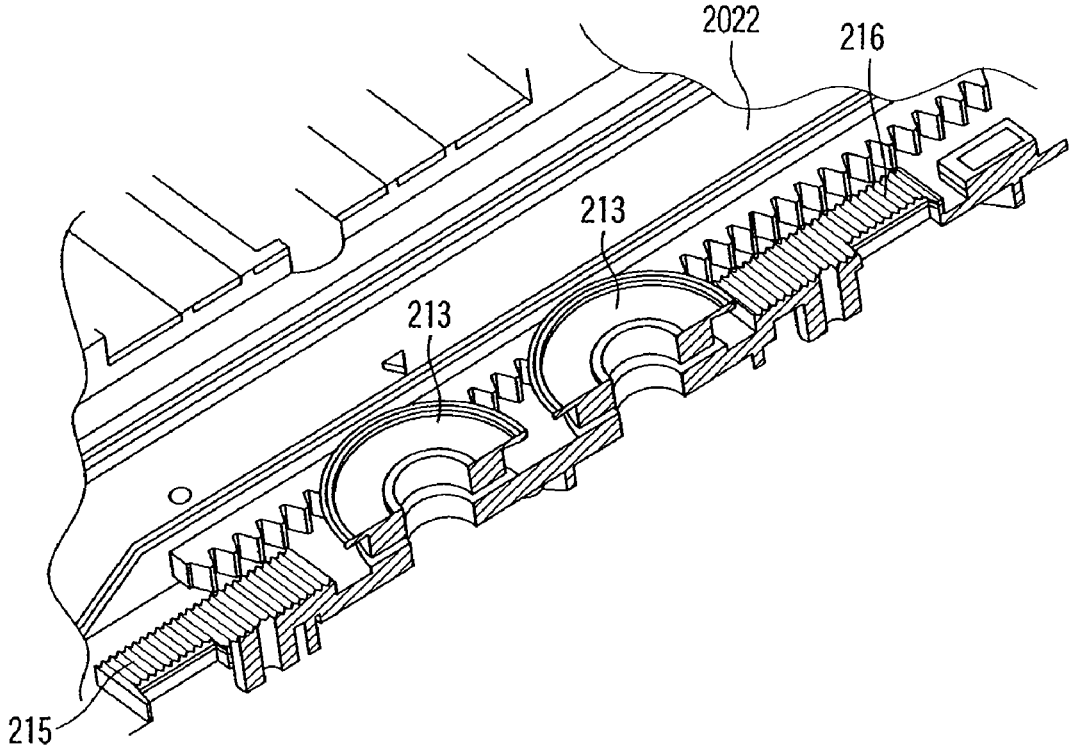
FIG. 36 is a sectional view showing the pinion gear according to the fifth embodiment.
Figure 37:
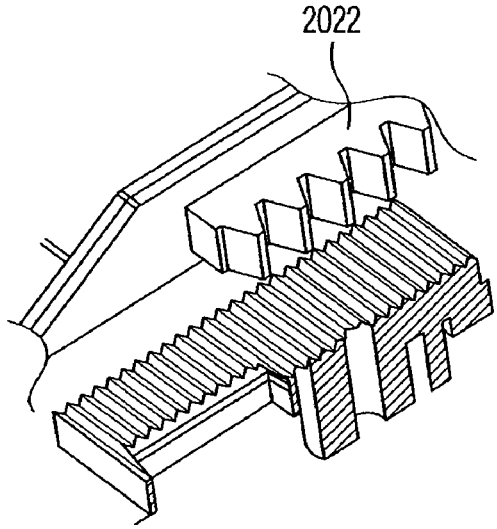
FIG. 37 is a sectional view of the pinion gear according to the fifth embodiment.

FIGS. 36 and 37 are sectional views taken along the line C-C of FIG. 35 in the width direction of the paper cassette 201. In the first fixing portion 215, a plurality of grooves are provided at intervals of 1 mm along the width direction of the paper cassette 201. The serrated teeth at regular intervals provided in the first fixing portion 215 and the second fixing portion 216 define a movement pitch of lateral misalignment correction (described below) by the pinion gear holding member 212.

The position fixing protrusion 2124 provided in the pinion gear holding member 212 is fitted into the fixing hole 219 of the paper cassette 201, and the pinion gear holding member 212 is fixed to the paper cassette 201. This fixed state is defined as a normal state. In the normal state, when the paper is stacked in the paper cassette 201, the front-side sidewall 202F and the rear-side sidewall 202R arrange the paper such that the just center of the paper cassette 201 in the width direction becomes the center axis of the paper in the longitudinal direction.

Figure 38:
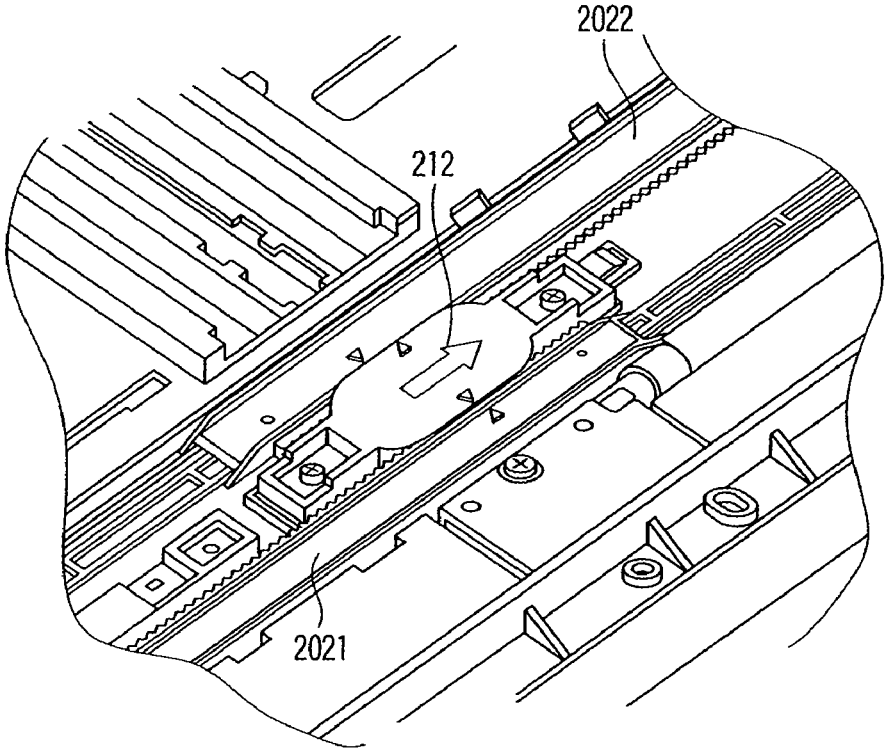
FIG. 38 is a diagram showing the pinion gear holding member mounted on the paper cassette according to the fifth embodiment.
Figure 39:
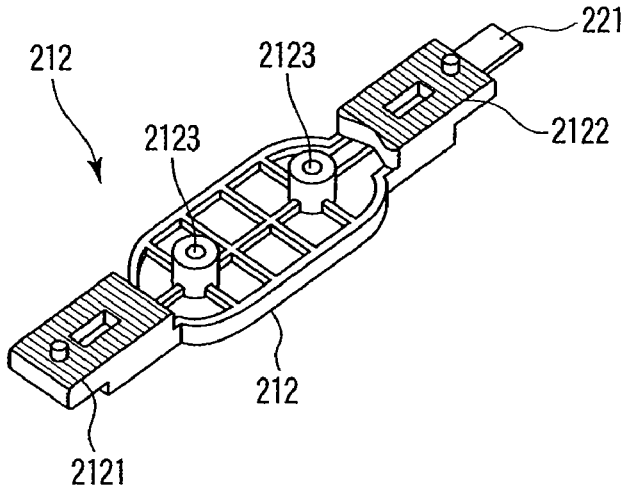
FIG. 39 is a diagram showing the rear surface of the pinion gear holding member according to the fifth embodiment.
Figure 40:
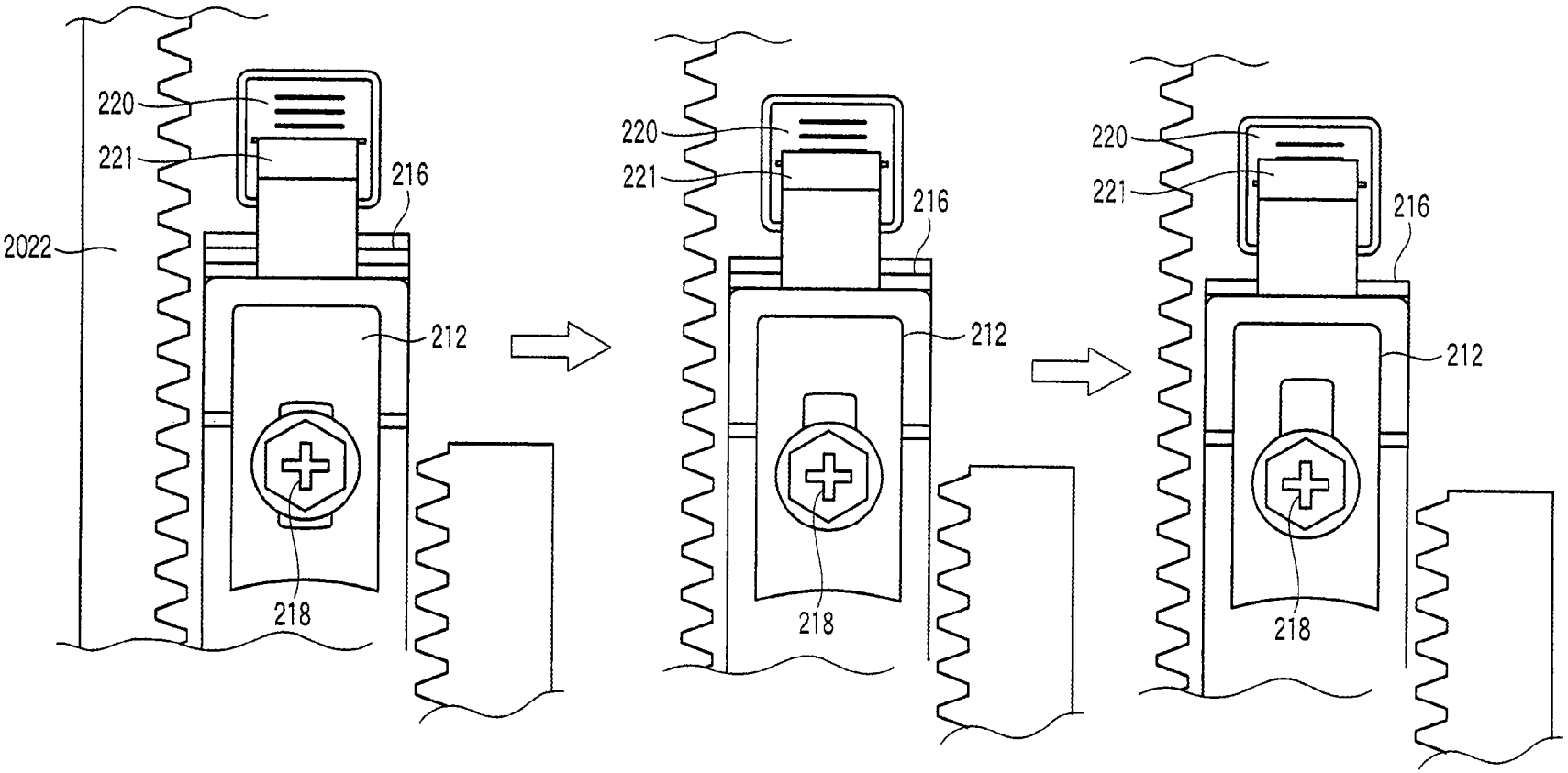
FIG. 40 is a diagram showing lateral misalignment correction of a paper by the pinion gear holding member according to the fifth embodiment.

Next, lateral misalignment correction of the paper by the pinion gear holding member 212 will be described. FIG. 38 is a diagram showing the paper cassette 201 in a state where the pinion gears 213 and the pinion gear holding member 212 are mounted in the paper cassette 201. FIG. 39 is a diagram showing the rear surface of the pinion gear holding member 212. FIG. 40 is a diagram showing lateral misalignment correction by the pinion gear holding member 212.

Here, a description will be provided for a case where the paper stacked in the paper cassette 201 is shifted by 1 mm to the depth side (an arrow direction of FIG. 38) of the paper cassette 201. As shown in FIG. 35, the position fixing protrusion 2124 is provided on the rear surface of the pinion gear holding member 212. The pinion gear holding member 212 is fixed to the paper cassette 201 in a state where the position fixing protrusion 2124 is provided on the rear surface of the pinion gear holding member 212 in the normal state. The position fixing protrusion 2124 is removed from the pinion gear holding member 212 shown in FIG. 39. Therefore, the user can fix the pinion gear holding member 212 with the position fixing protrusion 2124 removed to be shifted in the width direction of the paper cassette 201.

Here, the pinion gear holding member 212 is provided with a movement distance measurement member 221 at an end near the rear-side sidewall 202R in the width direction of the paper cassette 201. A front end of the movement distance measurement member 221 is shaped to be perpendicular to the width direction of the paper cassette 201. As shown in FIG. 40, at a predetermined position in the width direction of the paper cassette 201, a scale unit 221 is provided between the second fixing portion 216 and the rear-side sidewall 202R. The scale unit 221 has scale marks provided at regular intervals (here, 1 mm) in the width direction of the paper cassette 201, similarly to the first fixing portion 215 and the second fixing portion 216.

A left view in FIG. 40 shows a case where in the normal state, the pinion gear holding member 212 is fixed to the paper cassette 201. The front end of the movement distance measurement member 221 of the pinion gear holding member 212 is located at a reference scale mark as a predetermined reference position of the scale unit 221.

A center view of FIG. 40 illustrates movement of the pinion gear holding member 212 when lateral misalignment correction is performed to shift the paper stacked in the paper cassette 201 by 1 mm toward the depth side of the paper cassette 201. Usually, the rear-side sidewall 202R and the front-side sidewall 202F move in the width direction of the paper cassette 201 with the pinion gear holding member 212 and the pinion gears 213 fixed to the pinion gear holding member 212 as a center. Therefore, if the positions of the pinion gear holding member 212 and the pinion gears 213 fixed to the pinion gear holding member 212 in the width direction of the paper cassette 201 are shifted, the front-side sidewall 202F and the rear-side sidewall 202R arrange the paper such that the position shifted from the center in the width direction of the paper cassette 201 becomes the center axis in the longitudinal direction of the paper. This is lateral misalignment correction.

The first fixing portion 215, which is opposed to the first correction member 2121 provided in the pinion gear holding member 212, and the second fixing portion 216, which is opposed to the second correction member 2122 provided in the pinion gear holding member 212, are provided with grooves at an interval of 1 mm. Therefore, the user can move the pinion gear holding member 212 and the pinion gears 213 fixed to the pinion gear holding member 212 in an interval of 1 mm.

If the user moves the pinion gear holding member 212 and the pinion gears 213 fixed to the pinion gear holding member 212 by 1 mm toward the rear-side sidewall 202R, the front end of the movement distance measurement member 221 of the pinion gear holding member 212 is located at a scale mark ahead of the predetermined reference scale mark of the scale unit 221 by 1 mm.

A right view of FIG. 40 illustrates movement of the pinion gear holding member 212 when lateral misalignment correction is performed to shift the paper stacked in the paper cassette 201 by 2 mm toward the depth side of the paper cassette 201. Similarly, if the user moves the pinion gear holding member 212 and the pinion gears 213 fixed to the pinion gear holding member 212 by 2 mm toward the rear-side sidewall 202R, the front end of the movement distance measurement member 221 of the pinion gear holding member 212 is located at a scale mark ahead of the predetermined reference scale mark of the scale unit 221 by 2 mm.

Therefore, the user can read the value of the scale unit 221 indicated by the front end of the movement distance measurement member 221, thereby easily viewing how much lateral misalignment correction is made.

Here, when the user moves the pinion gear holding member 212 to perform lateral misalignment correction on the front-side sidewall 202F and the rear-side sidewall 202R, the first movable member 205 connected to the rear-side sidewall 202R by the first connection member 207 rotates at a different rotation angle from that in the normal state. Therefore, in a state where lateral misalignment correction is made, a press pattern of the comb-teeth member 2051 of the first movable member 205 against the four protrusion members 1021 is different from a press pattern of the comb-teeth member 2051 of the first movable member 205 against the four protrusion members 1021 in the normal state. The first sensor 102 may erroneously detect the size of the paper cassette 201 in the width direction in a state where lateral misalignment correction is made.

In this embodiment, the first movable member 205 in a state where lateral misalignment correction is made is moved to a position different from the first movable member 205 in the normal state.

Figure 41:
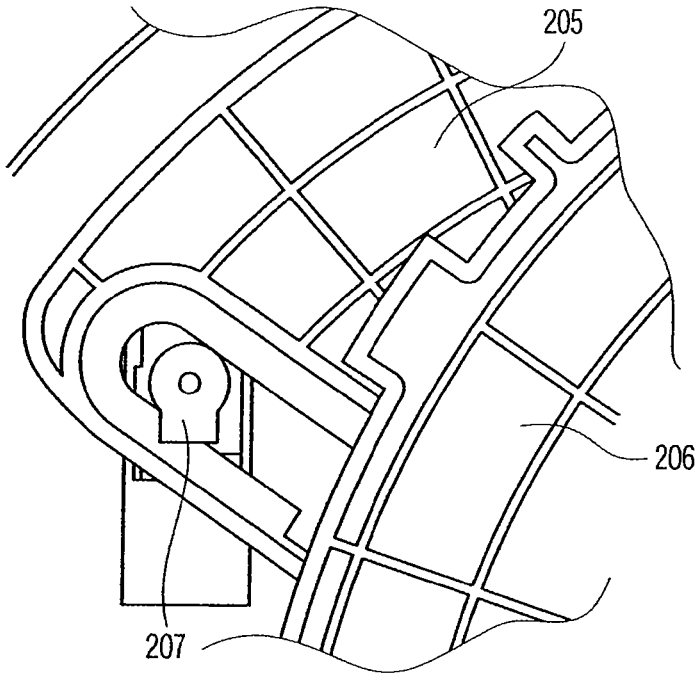
FIG. 41 is a diagram showing the first movable member and a first connection member according to the fifth embodiment.
Figure 42:
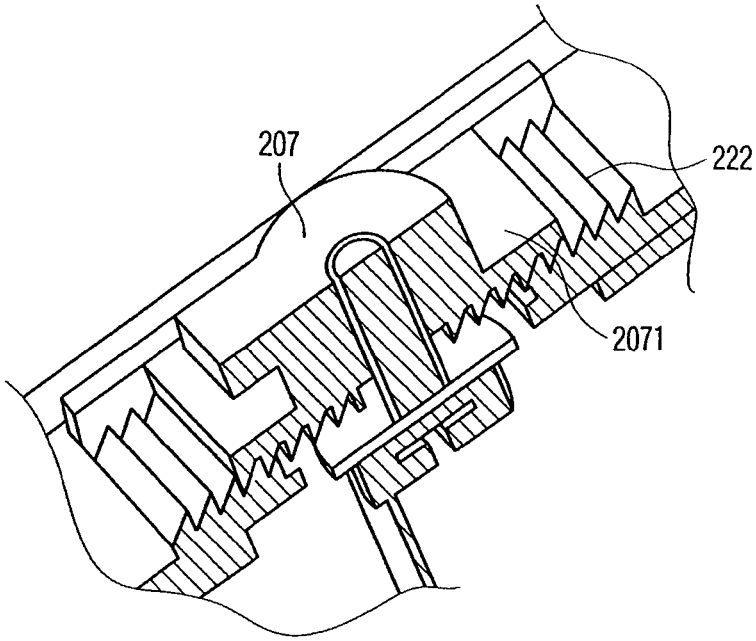
FIG. 42 is a diagram showing lateral misalignment correction of a paper by the first connection member according to the fifth embodiment.

FIG. 41 is a diagram of the first movable member 205 and the first connection member 207 when viewed from the rear surface of the paper cassette 201. FIG. 42 is a diagram showing lateral misalignment correction of the first movable member 205 by the first connection member 207. FIG. 42 is a sectional view taken along the line E-E of FIG. 41.

As shown in FIG. 28, the first connection member 207 that protrudes toward the rear surface of the paper cassette 201 is fixed by the screw 214. Then, as shown in FIG. 41, the first connection member 207 is fitted into the second joint groove 2054 provided in the first movable member 205.

Here, on the surface of the rear-side sidewall 202R which the first connection member 207 is in contact with, a groove 222 is provided at a regular interval (here, 1 mm) along the same direction as the movement direction of the front-side sidewall 202F and the rear-side sidewall 202R.

As shown in FIG. 42, on the surface of the first connection member 207 which the rear-side sidewall 202R is in contact with, a groove portion 2071 is also provided at a regular interval (here, 1 mm). That is, the groove 222 of the rear-side sidewall 202R and a groove provided in the groove portion 2071 of the first connection member 207 are the same interval as the grooves provided in the first fixing portion 215 and the second fixing portion 216, and the interval between the scale marks provided in the scale unit 221.

Figure 43:
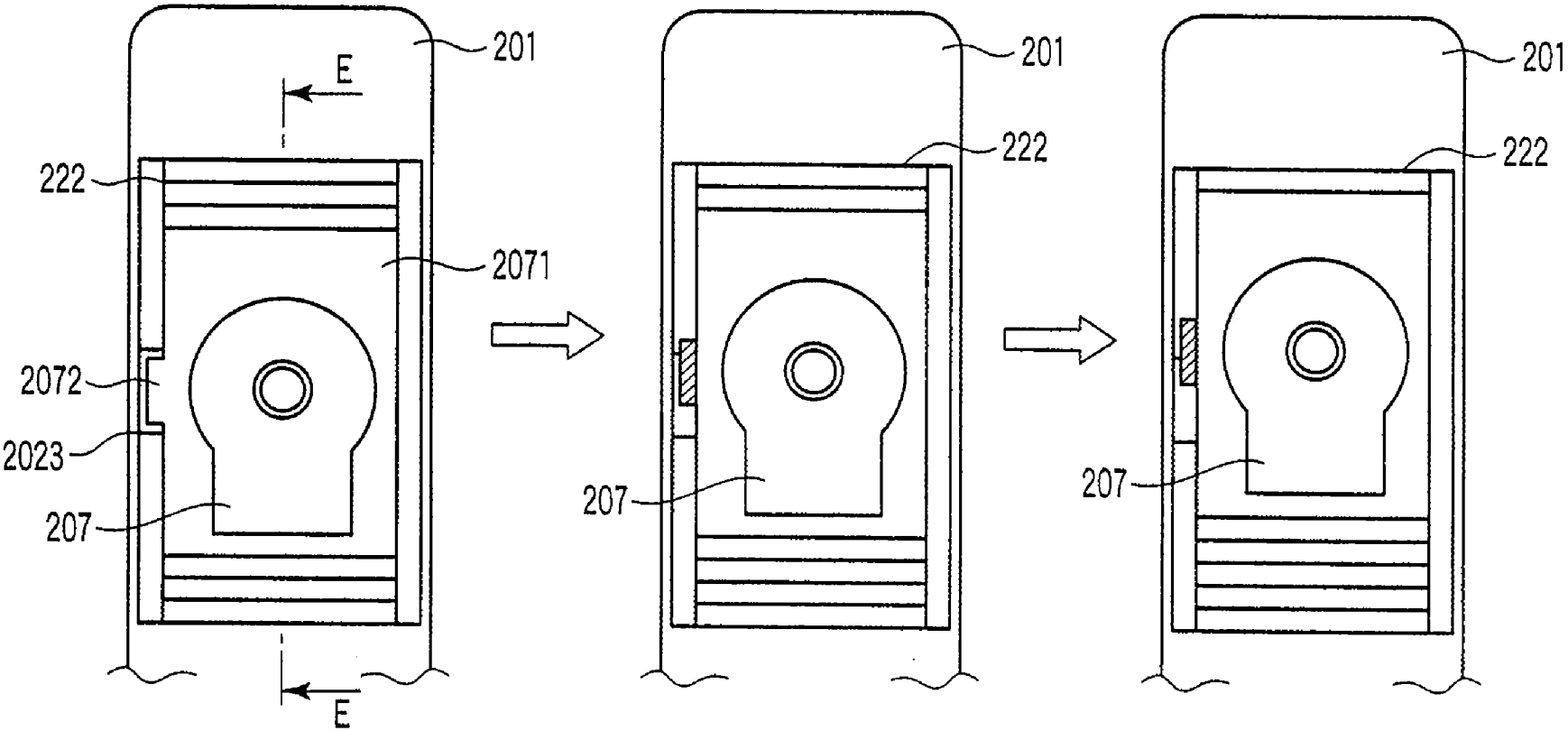
FIG. 43 is a sectional view of the first connection member according to the fifth embodiment.

A left view of FIG. 43 shows a state where in the normal state, the first connection member 207 is fitted into the groove 222 of the rear-side sidewall 202R. In the normal state, a protrusion 2072 that is provided at a predetermined reference position of the first connection member 207 is fitted into a cutout 2023 provided at a predetermined position of the rear-side sidewall 202R.

A center view of FIG. 43 illustrates movement of the first connection member 207 when lateral misalignment correction is performed to shift the paper stacked in the paper cassette 201 by 1 mm toward the depth side of the paper cassette 201. The user can draw out the protrusion 2072 of the first connection member 207, thereby moving the first connection member 207 in a direction in which the groove 222 of the rear-side sidewall 202R is provided. In this case, the user can move the first connection member 207 from the reference position by 1 mm in a direction from the front-side sidewall 202F toward the rear-side sidewall 202R.

When the pinion gear holding member 212 and the pinion gears 213 fixed to the pinion gear holding member 212 are moved from the reference position by 1 mm, the first connection member 207 is also moved from the reference position by 1 mm. Therefore, the first sensor 102 acquires the same pattern as that when in the normal state, the comb-teeth member 2051 of the first movable member 205 presses the four protrusion members 1021.

A right view of FIG. 43 illustrates movement of the first connection member 207 when lateral misalignment correction is performed to shift the paper stacked in the paper cassette 201 by 2 mm toward the depth side of the paper cassette 201. In this case, the user can move the first connection member 207 by 2 mm from the reference position in a direction from the front-side sidewall 202F toward the rear-side sidewall 202R.

When the pinion gear holding member 212 and the pinion gears 213 fixed to the pinion gear holding member 212 are moved from the reference position by 2 mm, the first connection member 207 is also moved from the reference position by 2 mm. Therefore, the first sensor 102 acquires the same pattern as that when in the normal state, the comb-teeth member 2051 of the first movable member 205 presses the four protrusion members 1021.

As described above, the user moves the first connection member 207 by the same distance according to the movement of the pinion gear holding member 212 and the pinion gears 213 fixed to the pinion gear holding member 212. Therefore, even if lateral misalignment correction is made, there is no case where the first sensor 102 erroneously detects the paper size. In addition, what is necessary is that the user moves the pinion gear holding member 212 and the first connection member 207 by the same distance. Therefore, it is possible to suppress the occurrence of erroneous detection due to a variation in lateral misalignment correction.

The protrusion 2072 provided in the first connection member 207 is used to hold the position of the first connection member 207 in the normal state. For this reason, there is no case where the first connection member 207 is erroneously attached when assembling. Therefore, there is no case where the first sensor 102 erroneously detects the paper size due to an error in assembling. In addition, for lateral misalignment correction of the paper, it is necessary for the user to bend (remove) the position fixing protrusion 2124 of the pinion gear holding member 212 and the protrusion 2072 of the first connection member 207. For this reason, it is possible to prevent the user from executing the lateral misalignment correction of the paper more than necessary, and it is possible to make the user to recognize that both the pinion gear holding member 212 and the first connection member 207 need to be moved in sets.

In this embodiment, the first connection member 207 is fixed to the rear surface of the rear-side sidewall 202R, but it may be fixed so as to movable with respect to the groove portion 2071 provided in the upper surface of the rear-side sidewall 202R.

Figure 44:
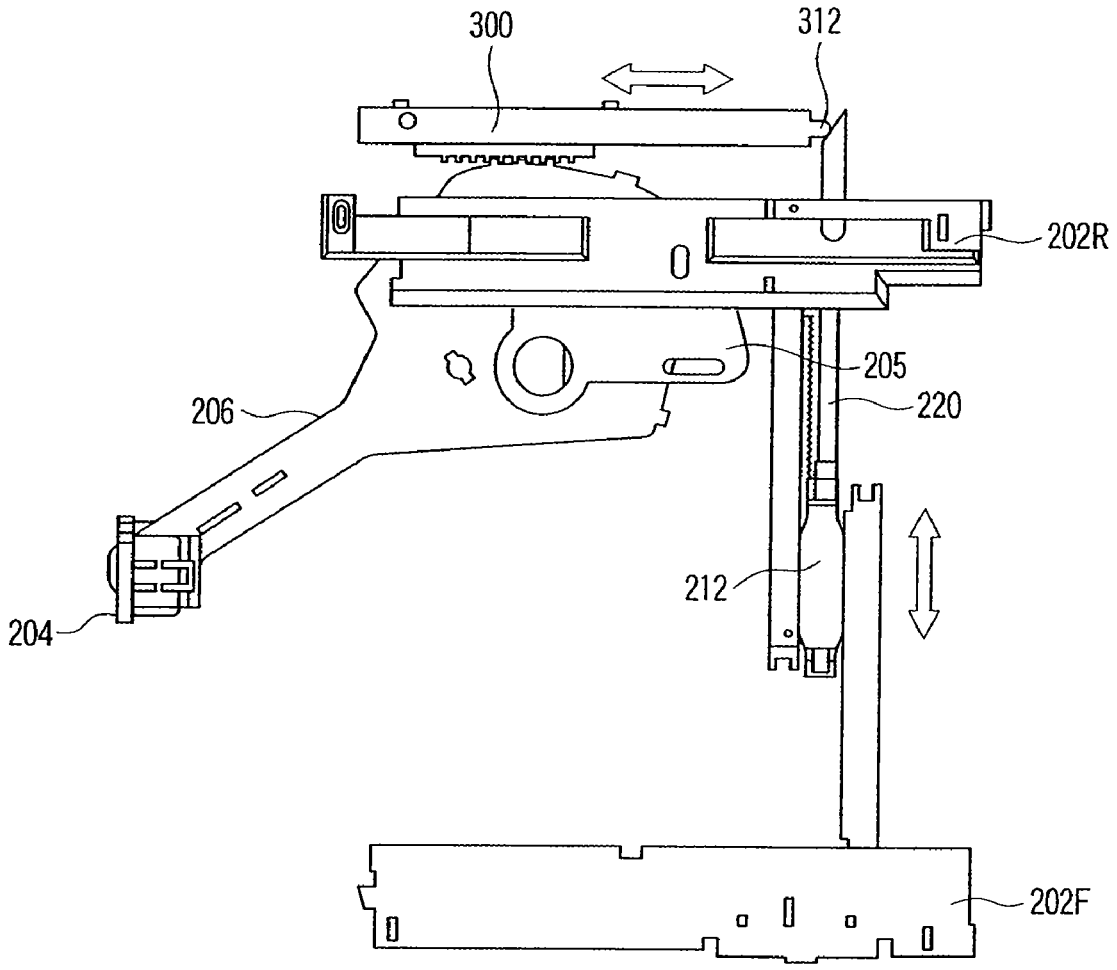
FIG. 44 is a top view showing a paper cassette provided with a first link member according to a sixth embodiment.

Next, a sixth embodiment will be described. Here, a case where lateral misalignment correction of the paper by the pinion gear holding member 212 shown in FIG. 40 is made will be described. In the fifth embodiment, the first movable member 205 in which lateral misalignment correction is performed is moved to a different position from the position of the first movable member 205 in the normal state, but in the sixth embodiment, as shown in FIG. 44, the sensor board 300, that is, the first sensor 102 is shifted by the first link member 220.

The link member 220 is, for example, a rod-shaped member that is connected to the pinion gear holding member 212. The link member 220 is provided in a direction from the front-side sidewall 202F toward the rear-side sidewall 202R, and extends to a position beyond the paper tray 20. As shown in the center view of FIG. 40, if the user moves the pinion gear holding member 212 toward the rear-side sidewall 202R, the first link member 220 is moved by the same distance in the same direction in connection with the pinion gear holding member 212.

Here, the sensor board 300 is provided in the housing 11 of the image forming apparatus 1. The sensor board 300 is provided in the housing 11 such that the first sensor 102 and the second sensor 103 are moved in the movement direction of the first link member 220, that is, in a direction perpendicular to the rear-side sidewall 202R and the end wall 204.

Since the first link member 220 is in contact at 45 degrees with a second link member 312 at a predetermined place of the sensor board 300, the sensor board 300 is moved by the same distance in accordance with the movement of the first link member 220. Therefore, when the user executes lateral misalignment correction by using the pinion gear holding member 212, the first link member 220 is also move in the same direction. The first link member 220 moves the sensor board 300, and thus it is possible to prevent the first sensor 102 of the sensor board 300 from erroneously detecting the size of the paper cassette 201 in the width direction when lateral misalignment correction is made. The first link member 220 moves the sensor board 300, thereby correcting an error in size detection due to lateral misalignment correction.

Figure 45:
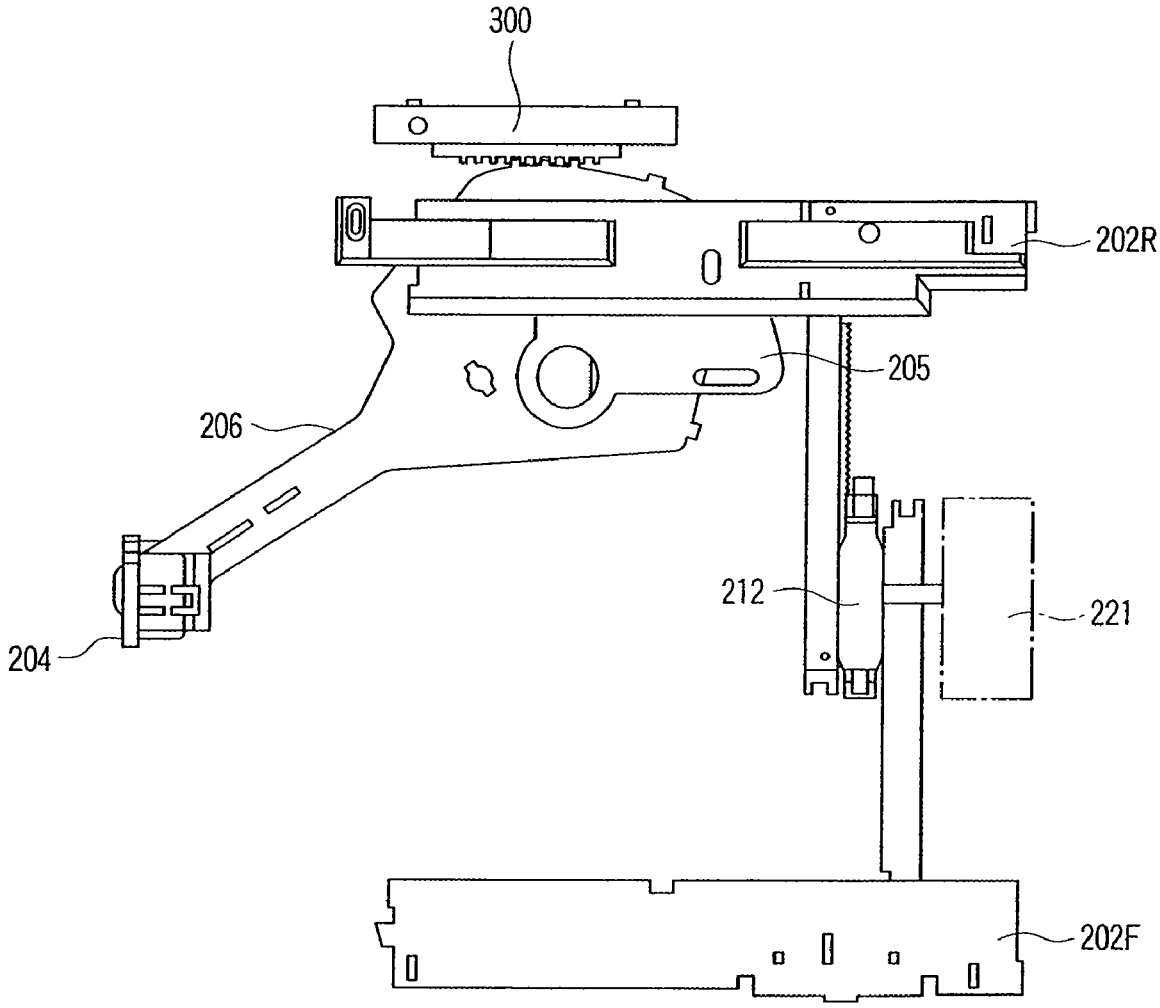
FIG. 45 is a top view showing the paper cassette provided with a lateral misalignment detection unit according to the sixth embodiment.

Next, other examples will be described. As shown in FIG. 45, the pinion gear holding member 212 is provided with a lateral misalignment detection unit 221. The lateral misalignment detection unit 221 detects the amount of movement from the normal state if the pinion gear holding member 212 is moved from the normal state.

If the pinion gear holding member 212 is moved from the normal state for lateral misalignment correction, a press pattern of the comb-teeth member 2051 of the first movable member 205 against the four protrusion members 1021 is different from a press pattern of the comb-teeth member 2051 of the first movable member 205 against the four protrusion members 1021 in the normal state.

Here, when the pinion gear holding member 212 is in the normal state, the RAM 5 records size associated information in which press patterns of the four protrusion members 1021 provided in the first sensor 102 are associated with the paper sizes in the width direction of the paper cassette 201. In addition, when the pinion gear holding member 212 undergoes lateral misalignment correction in units of 1 mm from the normal state, the RAM 5 records size associated information in which press patterns of the four protrusion members 1021, which vary depending on the amount of movement due to lateral misalignment correction, are associated with the paper sizes.

Figure 46:
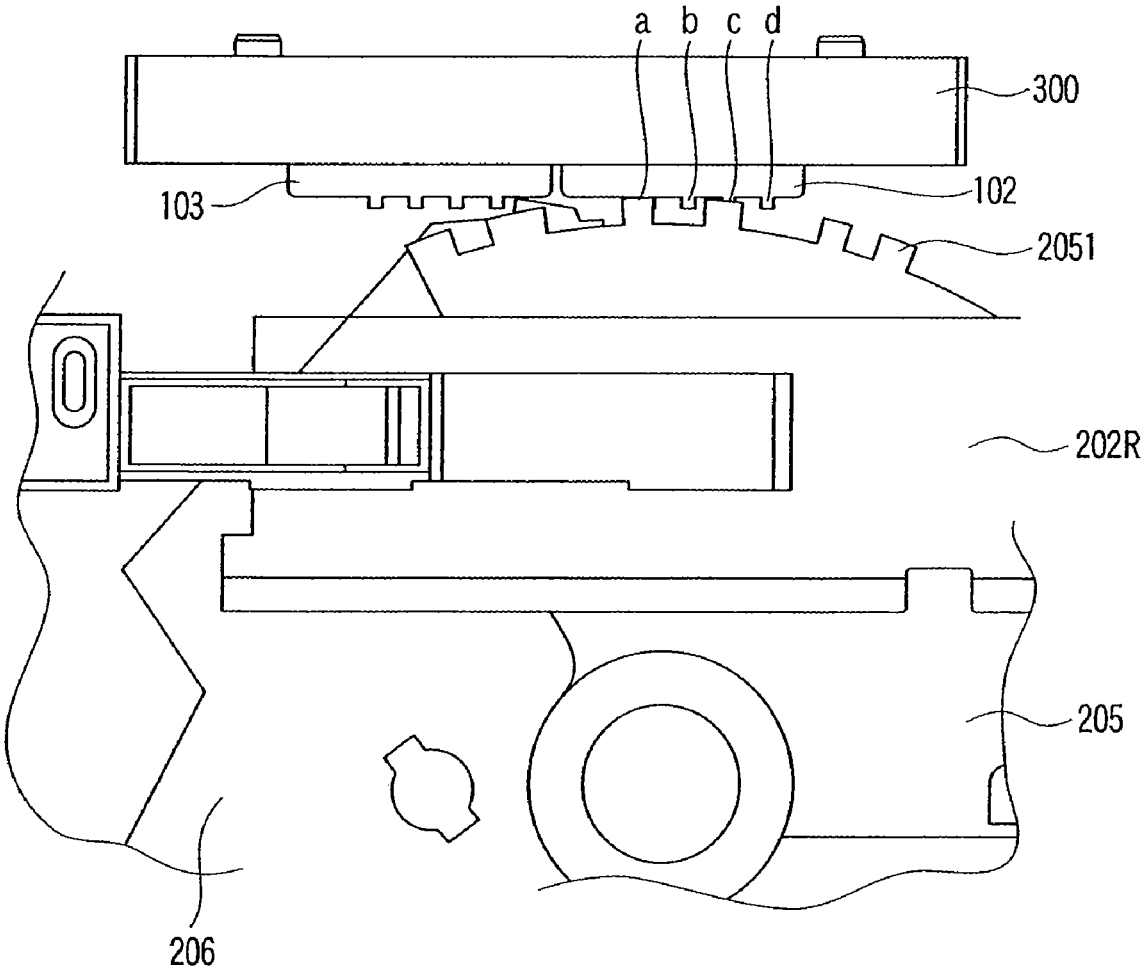
FIG. 46 is a diagram showing press of a first movable member 205 on a first sensor 102 according to the sixth embodiment.
Figure 47:
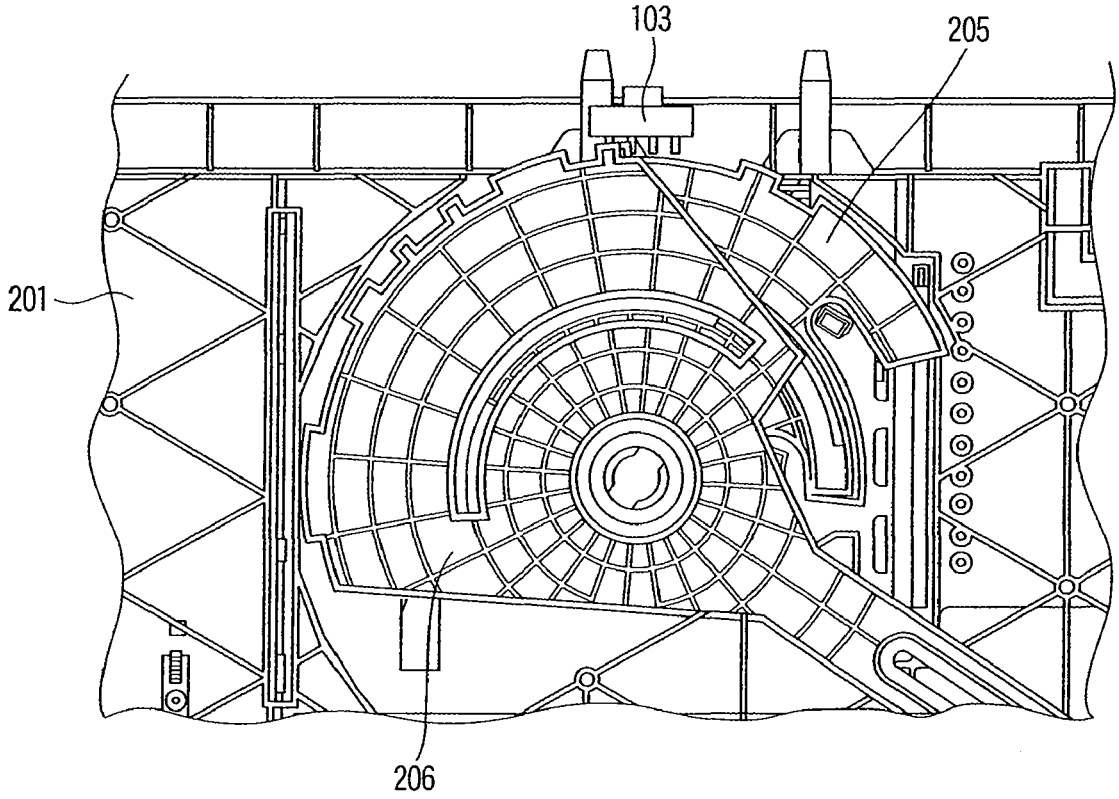
FIG. 47 is a diagram showing the rear surface of a paper cassette inserted into a known paper feeding apparatus.
Figure 48:
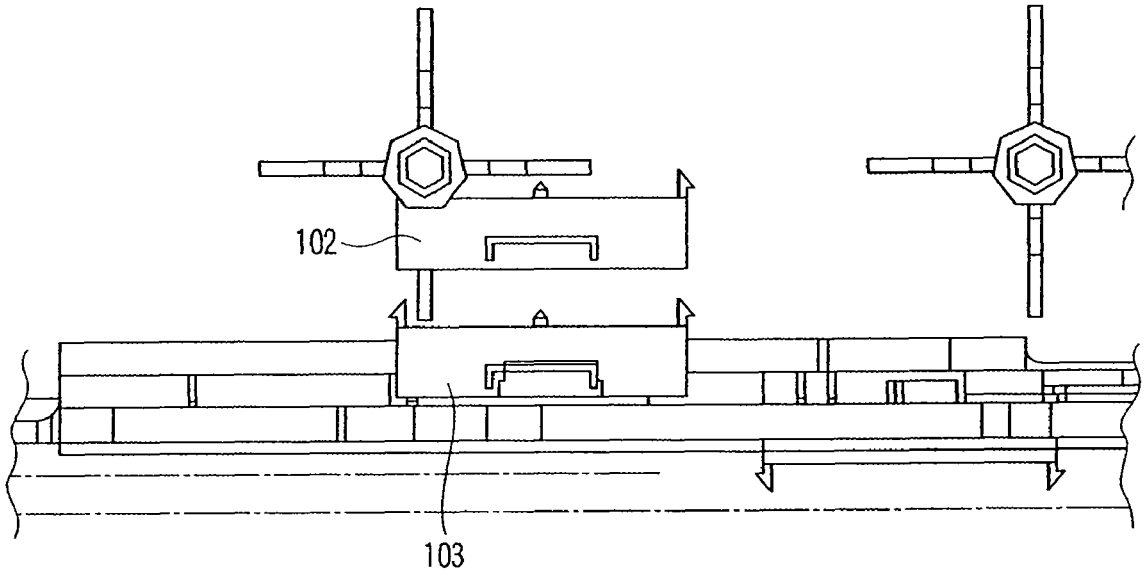
FIG. 48 is a diagram of known first sensor and second sensor when viewed from the depth side of the image forming apparatus.

Hereinafter, a specific example will be described. FIG. 46 is a diagram showing a state where the four protrusion members 1021 provided in the first sensor 102 are pressed by the first movable member 205. As shown in FIG. 10, for convenience of explanation, the four protrusion members 1021 provided in the first sensor 102 are called a protrusion a, a protrusion b, a protrusion c, and a protrusion d when viewed from the near side of the image forming apparatus 1.

A description will be provided for a case where the user moves the front-side sidewall 202F and rear-side sidewall 202R in accordance with a paper size A in the normal state. The comb-teeth member 2051 of the first movable member 205 presses the protrusion a and the protrusion c, for example, from among the four protrusions 1021. The CPU 3 compares a press pattern of the four protrusion members 1021 of the first sensor 102 with size associated information recorded in the RAM 5, in which the press patterns are associated with the paper sizes. When the press pattern is consistent with the size associated information, the CPU 3 determines that a paper of size A is stacked in the paper cassette 201.

Similarly, the user moves the front-side sidewall 202F and the rear-side sidewall 202R in accordance with a paper size B in the normal state. The comb-teeth member 2051 of the first movable member 205 presses the protrusion b and the protrusion d, for example, from among the four protrusion members 1021. When the press pattern is consistent with the size associated information recorded in the RAM 5, the CPU 3 determines that a paper of size B is stacked in the paper cassette 201.

Here, a description will be provided for a case where the user moves the pinion gear holding member 212 by 1 mm from the normal state by lateral misalignment correction. The user moves the front-side sidewall 202F and the rear-side sidewall 202R in accordance with the paper size A in a state where lateral misalignment correction is made by 1 mm. At this time, unlike the normal state, the comb-teeth member 2051 of the first movable member 205 presses the protrusion b and the protrusion d from among the four protrusion members 1021. When, the press pattern is consistent with the size associated information recorded in the RAM 5, and thus the CPU 3 erroneously determines that a paper of size B is stacked in the paper cassette 201.

In this embodiment, the RAM 5 records the size associated information in which in the normal state, the press pattern of the protrusions b and d from among the four protrusion members 1021 is associated with the paper size B. In addition, the RAM 5 records the size associated information in which, in a state where lateral misalignment correction is made by 1 mm, the press pattern of the protrusions b and d from among the four protrusion members 1021 is associated with the paper size A.

If the movement distance measurement member 221 determines that the pinion gear holding member 212 undergoes lateral misalignment correction by 1 mm, when comparing the press pattern by the first movable member 205 with the size associated information, the CPU 3 acquires from the RAM 5 size associated information when lateral misalignment correction is made by 1 mm and executes the comparison.

Similarly, the RAM 5 records size associated information in which, when the pinion gear holding member 212 undergoes lateral misalignment correction by 2 mm from the normal state, press patterns of the four protrusion members 1021 are associated with the paper sizes. The same is applied to a case where the pinion gear holding member 212 undergoes lateral misalignment correction by 3 mm or more from the normal state.

Therefore, if the movement distance measurement member 221 serving as a correction sensor measures a movement distance of the pinion gear holding member 212 for lateral misalignment correction, when comparing the press pattern by the first movable member 205 with size associated information, the CPU 3 acquires size associated information according to the movement distance subjected to lateral misalignment correction from the RAM 5 and executes the comparison.

As described above, since the RAM 5 has size associated information according to the movement distance subjected to lateral misalignment correction, the CPU 3 can reliably discriminate the size of a paper actually stacked in the paper cassette 201. In this example, the RAM 5 records size associated information, in which press patterns of the first movable member 205 against the sensors of the first sensor 102 are associated with the paper size, according to the movement distance subjected to lateral misalignment correction, but the same is applied to the press patterns of the second movable member 206 against the sensors of the second sensor 103.

With the above-described configuration, lateral misalignment correction and accurate paper size detection by the first sensor 102 can be compatibly achieved.

In the foregoing example, a plurality of protrusion members 1021 are provided in the first sensor 102, and the comb-teeth member 2051 of the first movable member 205 presses the protrusion members 1021. Alternatively, instead of the protrusion members 1021, an optical sensor or a magnetic sensor may be provided. In this case, instead of the comb-teeth member 2051, a plurality of holes or metal pieces transmitting light may be provided to the first movable member 205. The same is applied to the second sensor 103 or the second movable member 206.

What is claimed is:

1. A paper feeding apparatus comprising:

a cassette main body that stacks a paper therein;

a sidewall that moves in a width direction of the cassette main body;

an end wall that moves in a longitudinal direction of the cassette main body;

a first movable member that rotates around a shaft axially fixed to the cassette main body in connection with the sidewall, has a first detection portion, and is connected to the sidewall;

a second movable member that rotates around a shaft axially fixed to the cassette main body in connection with the end wall, has a second detection portion, and is connected to the end wall;

a first detection unit that detects the size of the paper in the width direction according to the first detection portion;

a second detection unit that detects the size of the paper in the longitudinal direction according to the second detection portion;

a position correction member that adjusts the position of the sidewall from a reference position in the width direction of the cassette main body; and a connection member that connects the sidewall and the first movable member and moves from the reference position in the width direction of the cassette main body.

2. The apparatus according to claim 1, wherein, a pattern detected by the first detection unit when the position correction member moves from the reference position in the width direction of the cassette main body by a predetermined distance, the connection member moves from the reference position in an inverse direction and the same distance as the movement of the position correction member, and the sidewall is set on a paper of a specific size stacked in the cassette main body, is the same as a pattern detected by the first detection unit when the position correction member and the connection member are located at the reference position, and the sidewall is set on the paper of a specific size stacked in the cassette main body.

3. A paper feeding apparatus comprising:

a cassette main body that stacks a paper therein;

a sidewall that moves in a width direction of the cassette main body;

an end wall that moves in a longitudinal direction of the cassette main body;

a first detection unit that detects the size of the paper in the width direction and is arranged on a detection unit holding member;

a second detection unit that detects the size of the paper in the longitudinal direction and is arranged on a detection unit holding member;

a first movable member that rotates around a shaft axially fixed to the cassette main body in connection with the sidewall, is connected to the sidewall, and is opposed to the first detection unit;

a second movable member that rotates around a shaft axially fixed to the cassette main body in connection with the end wall, is connected to the end wall, and is opposed to the second detection unit;

a position correction member that adjusts the position of the sidewall from a reference position in the width direction of the cassette main body;

a first link member that is provided in the position correction member and extends in the width direction; and a second link member that, when the position correction member is adjusted, controls the position of the detection unit holding member in connection with the operation of the first link member.

4. A paper feeding apparatus comprising:

a cassette main body that stacks a paper therein;

a sidewall that moves in a width direction of the cassette main body;

an end wall that moves in a longitudinal direction of the cassette main body;

a first detection unit that detects the size of the paper in the width direction and is arranged on a detection unit holding member;

a second detection unit that detects the size of the paper in the longitudinal direction and is arranged on a detection unit holding member;

a first movable member that rotates around a shaft axially fixed to the cassette main body in connection with the sidewall, is connected to the sidewall, and is opposed to the first detection unit;

a second movable member that rotates around a shaft axially fixed to the cassette main body in connection with the end wall, is connected to the end wall, and is opposed to the second detection unit;

a position correction member that adjusts the position of the sidewall from a reference position in the width direction of the cassette main body;

a correction sensor that detects the amount of movement of the position correction member from the reference position;

a storage unit that stores first information, in which when the position correction member is at the reference position, a pattern detected by the first detection unit is associated with the size in the width direction, and second information which is different from the first information, and in which when the position correction member is adjusted, a pattern detected by the first detection unit is associated with the size in the width direction; and a control unit that detects the paper size by using the first information when the position correction member is at the reference position and using the second information when the position correction member is adjusted.

5. A paper feeding apparatus comprising:

a cassette main body that stacks a paper therein;

a sidewall that moves in a width direction of the cassette main body;

an end wall that moves in a longitudinal direction of the cassette main body;

a first movable member that rotates around a shaft axially fixed to the cassette main body in connection with the sidewall, has a first detection portion, and is connected to the sidewall;

a second movable member that rotates around a shaft axially fixed to the cassette main body in connection with the end wall, has a second detection portion, and is connected to the end wall;

a first detection unit that detects the size of the paper in the width direction according to the first detection portion;

a second detection unit that detects the size of the paper in the longitudinal direction according to the second detection portion;

a float member in which the first detection unit and the second detection unit are provided as a single body and has a first opening; and a holder member that holds the float member, has a first protrusion fitted into the first opening which has a diameter larger than that of the first protrusion, and is fixed to the paper feeding apparatus.

6. The apparatus of claim 5, wherein the cassette main body has a second protrusion, and when the cassette main body is inserted into the paper feeding apparatus, the second protrusion is fitted into a second opening provided in the float member.

7. The apparatus of claim 5, wherein the cassette main body has a plurality of second protrusions and the float member has a plurality of second openings corresponding to the number of the second protrusions, and when the cassette main body is inserted into the paper feeding apparatus, the second protrusions are each fitted into a corresponding second opening.

8. The apparatus of claim 7, wherein each of the second protrusions has a smaller diameter at the front end thereof.

9. The apparatus of claim 7, wherein the second openings are purled.

10. The apparatus of claim 7, wherein at least one of the second openings has a long hole shape in the horizontal direction.

11. A paper feeding apparatus comprising:

a cassette main body that stacks a paper therein;

a sidewall that moves in a width direction of the cassette main body;

an end wall that moves in a longitudinal direction of the cassette main body;

a first movable member that rotates around a first rotation axis with respect to the cassette main body in connection with the sidewall, is connected to the sidewall, and has a first detection portion;

a second movable member that rotates around a second rotation axis with respect to the cassette main body in connection with the end wall, is connected to the end wall, is provided at a position opposed to the first rotation axis, and has a second detection portion, the second rotation axis being opposed to the first movable member and being provided at a position different from the first rotation axis along the width direction;

a first detection unit that detects the size of the paper in the width direction according to the first detection portion and is provided at a position opposed to the first movable member; and a second detection unit that detects the size of the paper in the longitudinal direction according to the second detection portion, is provided at a position opposed to the second movable member, and at least partially overlaps with the first detection unit in a horizontal direction.

* * * * *